US012774142B2

(12) United States Patent
Shimono

(10) Patent No.: US 12,774,142 B2
(45) Date of Patent: Oct. 27, 2026

(54) POUCH

(71) Applicant: TOPPAN HOLDINGS INC., Tokyo (JP)

(72) Inventor: Takahiro Shimono, Tokyo (JP)

(73) Assignee: TOPPAN HOLDINGS INC., Tokyo (JP)

( * ) Notice: Subject to any disclaimer, the term of this patent is extended or adjusted under 35 U.S.C. 154(b) by 110 days.

(21) Appl. No.: 18/750,311

(22) Filed: Jun. 21, 2024

(65) Prior Publication Data

US 2024/0336416 A1 Oct. 10, 2024

Related U.S. Application Data

(63) Continuation of application No. PCT/JP2022/047717, filed on Dec. 23, 2022.

(30) Foreign Application Priority Data

Dec. 24, 2021 (JP) ..... 2021-211617

(51) Int. Cl.
*B65D 75/32* (2006.01)
*B65D 75/00* (2006.01)
(Continued)

(52) U.S. Cl.
CPC ..... *B65D 75/32* (2013.01); *B65D 75/008* (2013.01); *B65D 75/5805* (2013.01); *B65D 81/3461* (2013.01)

(58) Field of Classification Search
CPC .. B65D 75/32; B65D 75/008; B65D 75/5805; B65D 81/3461
(Continued)

(56) References Cited

U.S. PATENT DOCUMENTS

2005/0255200 A1* 11/2005 Takahagi ..... A23L 5/15 426/113
2009/0035424 A1* 2/2009 Mita ..... B32B 27/36 426/118
(Continued)

FOREIGN PATENT DOCUMENTS

JP 2013-256323 A 12/2013
JP 2018-127257 A 8/2018
(Continued)

OTHER PUBLICATIONS

International Searching Authority, "International Search Report," issued in connection with International Patent Application No. PCT/JP2022/047717, dated Mar. 14, 2023.
(Continued)

*Primary Examiner* — Peter N Helvey
(74) *Attorney, Agent, or Firm* — Foley & Lardner LLP

(57) ABSTRACT

A pouch with a pair of stacked sheet parts and a pair of side seal parts at both edges extending in a first direction of the pair of sheet parts and sealed to form an accommodation space. At least one side seal part has a first seal part positioned close to a top part, a second seal part positioned close to a bottom part and separated from the first seal part, and a steam releasing seal part connecting the first and the second seal parts. The steam releasing seal part exhibits a triangular shape having a peak part on an accommodation space side and is symmetrical to a first virtual line passing through the peak part and orthogonal to the first direction. A region surrounded by the steam releasing seal part is a non-sealed region, and the non-sealed region of at least one sheet part has a penetration part.

6 Claims, 17 Drawing Sheets

(51) Int. Cl.
*B65D 75/58* (2006.01)
*B65D 81/34* (2006.01)

(58) Field of Classification Search
USPC ..... 383/100
See application file for complete search history.

(56) References Cited

U.S. PATENT DOCUMENTS

2020/0017276 A1* 1/2020 Hongou ..... B65D 33/01
2020/0198841 A1* 6/2020 Tanaka ..... B65D 33/01

FOREIGN PATENT DOCUMENTS

JP 2019-163080 A 9/2019
JP 2021-165170 A 10/2021

OTHER PUBLICATIONS

International Searching Authority, "Written Opinion," issued in connection with International Patent Application No. PCT/JP2022/047717, dated Mar. 14, 2023.

* cited by examiner

POUCH

CROSS-REFERENCE TO RELATED PATENT APPLICATIONS

This application is a continuation application filed under 35 U.S.C. § 111 (a) claiming the benefit under 35 U.S.C. §§ 120 and 365 (c) of International Patent Application No. PCT/JP2022/047717, filed on Dec. 23, 2022, which is based upon and claims the benefit to Japanese Patent Application No. 2021-211617 filed on Dec. 24, 2021, the disclosures of all which are incorporated herein by reference in their entirety.

TECHNICAL FIELD

The present invention relates to a pouch.

BACKGROUND

Background Art

The pouches described in PTL 1 and 2 are known as pouches for accommodating contents (such as a food products), and heating the contents. The pouch described in PTL 1 has a structure for releasing steam generated when the contents are heated. Specifically, in the pouch described in PTL 1, a lateral seal part (side seal part) of the pouch has a projecting portion that projects toward an accommodation space side. The inside of the projecting portion is a non-sealed region. When the contents are heated and steam is generated, the seal of the projecting portion becomes detached. As a result, the space accommodating the contents and the non-sealed region become connected, and the steam is discharged from the non-sealed region using the non-sealed region as a steam vent. [Citation List] [Patent Literature] PTL 1: JP 2018-127257 A; PTL 2: JP 2019-163080 A.

SUMMARY OF THE INVENTION

Problem to be Solved by the Invention

Normally, a pouch supplier manufactures a pouch in a state where a top part is open, and supplies the pouch to a content manufacturer that manufactures the contents. The content manufacturer accommodates the contents inside the supplied pouch, and then seals the contents inside the pouch by sealing the top part.

The pouch supplier manufactures the pouch in a state where a recommended seal strength of a top seal part is set according to the use of the pouch. However, as described above, the final sealing of the top part is carried out by the content manufacturer. Even if the content manufacturer has been informed of the recommended seal strength by the pouch supplier, there is a concern that the top part may be sealed at a seal strength that is lower than the recommended seal strength. If the top part is sealed at a seal strength that is lower than the recommended seal strength, it is possible that the top part seal may become detached when the end user of the pouch heats the pouch, for example, in a microwave, causing some of the contents to spill out.

Therefore, the present invention has an object of providing a pouch that enables a retraction amount of a top seal part to be suppressed during heating.

Solution to Problem

A pouch according to at least one aspect of the present invention is a pouch having an accommodation space that accommodates contents between a bottom part, and a top part on an opposite side to the bottom part, the pouch comprising:

a pair of stacked sheet parts; and a pair of side seal parts that are provided at both edges extending in a first direction of the pair of sheet parts and sealed so that the pair of sheet parts forms the accommodation space; wherein of the pair of side seal parts, at least one side seal part has a first seal part that is positioned close to the top part, a second seal part that is positioned closer to the bottom part than to the first seal part and separated from the first seal part, and a steam releasing seal part for releasing steam that connects the first seal part and the second seal part, and projects onto the accommodation space side, the steam releasing seal part exhibits a triangular shape having a peak part on the accommodation space side, and is symmetrical with respect to a first virtual line passing through the peak part and orthogonal to the first direction, a region surrounded by the steam releasing seal part is a non-sealed region, and the non-sealed region of at least one sheet part among the pair of sheet parts has a penetration part that penetrates the at least one sheet part in a thickness direction.

The pouch described above has a steam releasing seal part having a substantially triangular shape, and the penetration part in the non-sealed region. As a result, it is possible to discharge the steam that is generated inside the pouch, when the pouch is heated, from the steam releasing seal part and the penetration part. As a result, because it is difficult for the internal pressure inside the pouch to increase, it is possible to suppress the retraction amount of the top seal part.

The penetration part has a first end, and a second end on an opposite side to the first end, and a region of the penetration part other than between the first end and the second end may be separated from a second virtual line that connects the first end and the second end. In this case, it is difficult for the pouch to rotate even when steam is released from the steam releasing seal part and the penetration part during heating of the pouch.

The penetration part may exhibit an arc shape. In this case, it is difficult for the pouch to rotate even when steam is released from the steam releasing seal part and the penetration part during heating of the pouch.

At least part of the penetration part may be on the first virtual line.

A part of the penetration part may be further toward an accommodation space side than a third virtual line is that virtually extends an edge of the first seal part and the second seal part that is positioned most toward the accommodation space side. In this case, it is difficult for the pouch to rotate even when steam is released from the steam releasing seal part and the penetration part during heating of the pouch.

The penetration part may be formed in both of the pair of sheet parts. In this case, the steam is released more easily.

Advantageous Effects of the Invention

According to the present invention, a pouch can be provided in which a retraction amount of a top seal part can be suppressed during heating.

DETAILED DESCRIPTION

Figure 1:
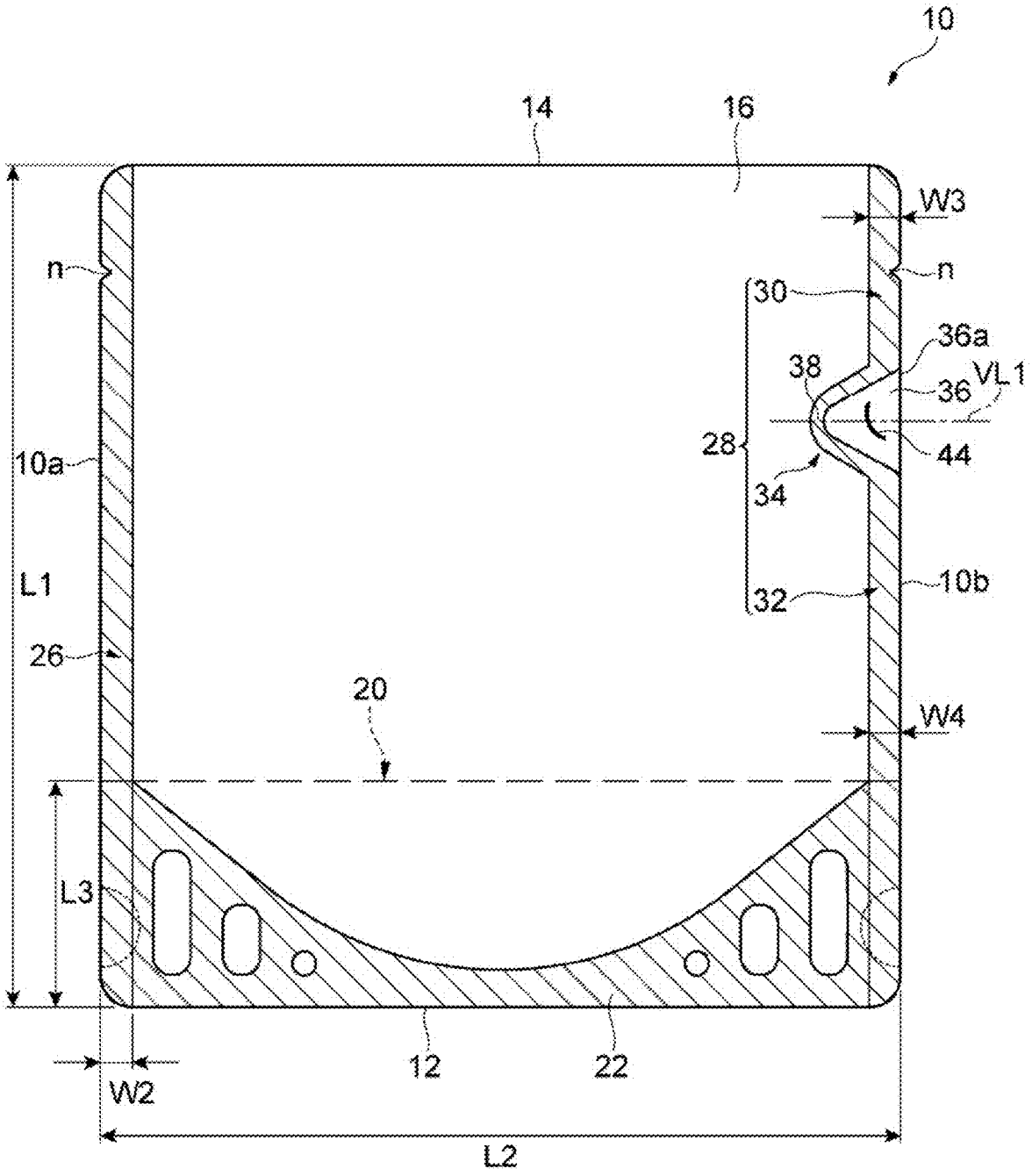
FIG. 1 is a diagram schematically illustrating an example of a pouch according to an embodiment in a state where a top part is open.

Hereinafter, an embodiment of the present invention will be described with reference to the drawings. The same elements will be referred to by the same reference signs. Duplicate descriptions will be omitted. The dimensional ratios in the drawings do not necessarily correspond to those used in the description.

Figure 2:
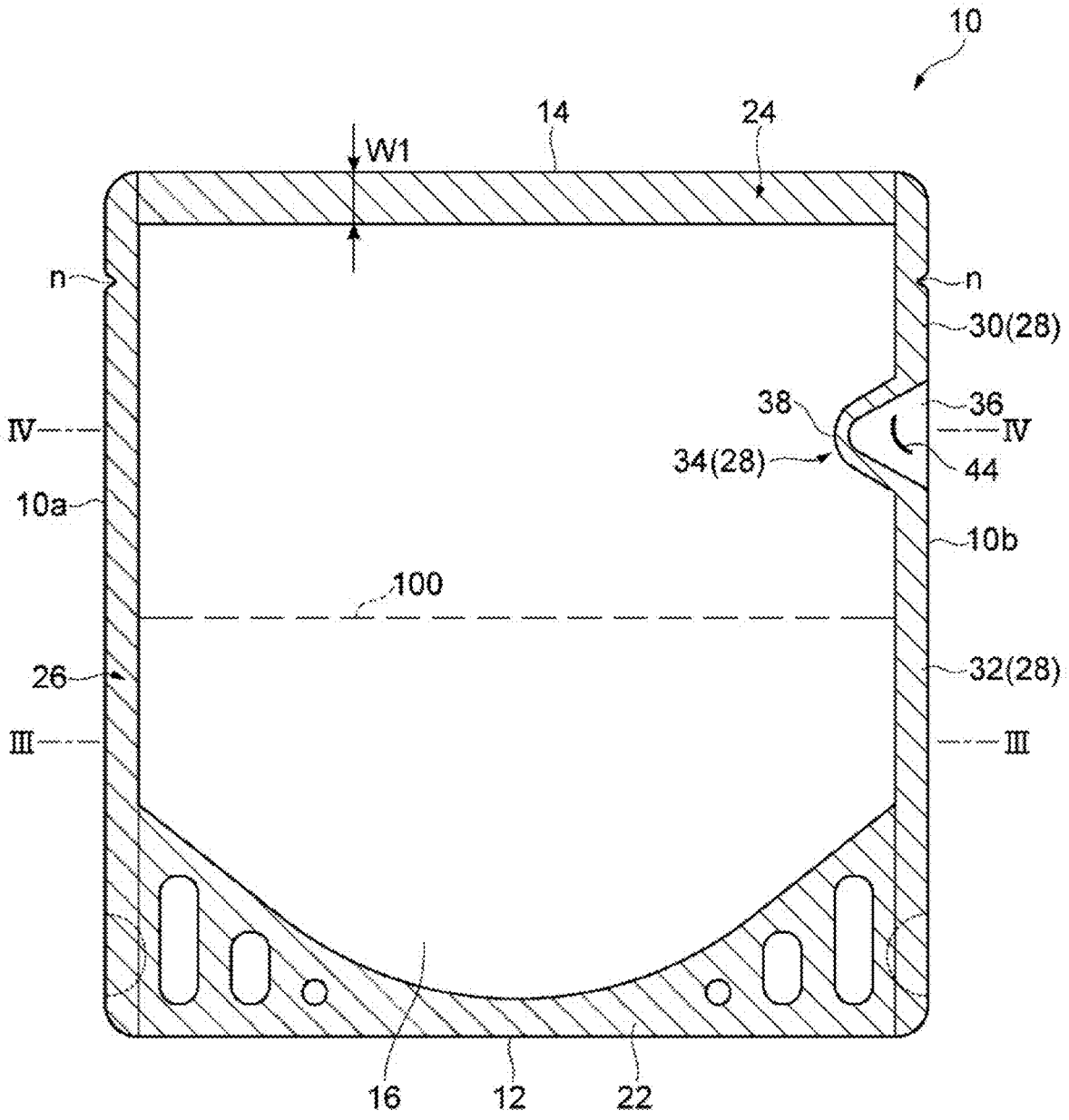
FIG. 2 is a diagram schematically illustrating the pouch shown in FIG. 1 in a state where the top part is closed.
Figure 3:
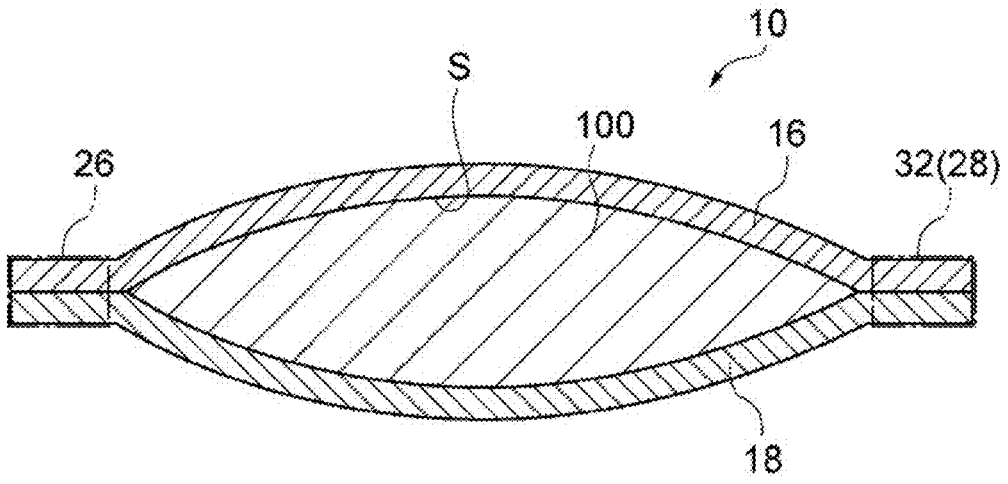
FIG. 3 is an end view taken along line III-III in FIG. 2.
Figure 4:
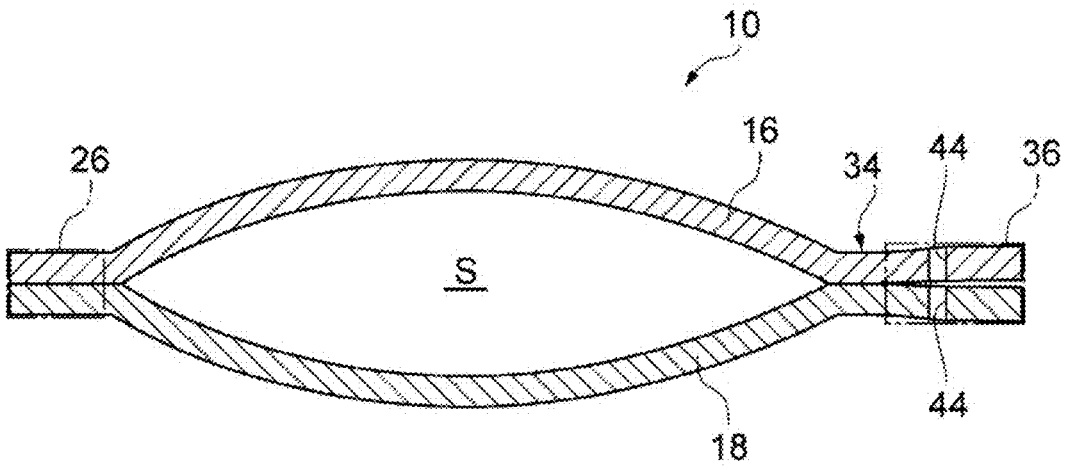
FIG. 4 is an end view taken along line IV-IV in FIG. 2.

FIG. 1 is a diagram schematically illustrating an example of a pouch 10 according to an embodiment in a state where a top part is open. FIG. 2 is a diagram schematically illustrating the pouch 10 shown in FIG. 1 in a state where the top part is closed. FIG. 3 is an end view taken along line III-III in FIG. 2. FIG. 4 is an end view taken along line IV-IV in FIG. 2.

The pouch 10 includes an accommodation space S that accommodates contents 100 between a bottom part 12 and a top part 14 that is positioned on the opposite side to the bottom part 12 (see FIGS. 3 and 4). The pouch 10 is a free-standing packaging bag known as a standing pouch. Hereinafter, a state where the top part 14 for accommodating the contents 100 is referred to as an open state, and a state in which the top part 14 is closed is referred to as a closed state. The pouch 10 in the closed state is the pouch 10 that is provided to an end user.

For example, the contents 100 are a food product. The contents 100 are, for example, a food product having fluidity (such as a curry, a hamburger steak, a stew, or a soup). The pouch 10 is a packaging bag for cooking the contents 100, for example, by heating in a microwave or the like.

Hereinafter, for convenience of the description, the top part 14 side of the pouch 10 is sometimes referred to as the "upper side", the bottom part 12 side is sometimes referred to as the "lower side", the extending direction of a side edge 10*a* (or a side edge 10*b*) of the pouch 10 is sometimes referred to as the vertical direction (first direction), and the direction orthogonal to the vertical direction is sometimes referred to as the horizontal direction (or the width direction). The vertical direction is also a direction orthogonal to the outer edge of the bottom part 12 (bottom side), or the outer edge of the top part 14 (top side).

An example of the shape of the pouch 10 in plan view (the shape when viewed from the thickness direction) is a rectangular shape or a square shape. An example of the vertical direction length L1 of the pouch 10 is 100 mm to 180 mm, and an example of the horizontal direction length L2 is 100 mm to 200 mm.

The pouch 10 includes a pair of stacked sheet parts 16 and 18 (see FIGS. 3 and 4), and a sheet part 20 (see FIG. 1).

The pair of sheet parts 16 and 18 represent a front surface sheet part (or a first side surface sheet part) and a rear surface sheet part (or a second side surface sheet part) of the pouch 10. The shape of the pair of sheet parts 16 and 18 in plan view is a shape corresponding to the shape of the pouch 10 in plan view. The sheet part 20 is a sheet part for forming the bottom part 12 of the pouch 10.

The sheet part 16, the sheet part 18, and the sheet part 20 are each terms for conveniently distinguishing the front surface, the rear surface, and the bottom part of the pouch 10. Therefore, for example, the sheet part 16, the sheet part 18, and the sheet part 20 may each be a single sheet, or the sheet part 16, the sheet part 18, and the sheet part 20 may be formed of a single sheet.

The sheet part 16, the sheet part 18, and the sheet part 20, for example, may include an outermost layer and a sealant layer (innermost layer).

The outermost layer has mechanical strength, and also heat resistance to an extent that prevents deformation during heat sealing. Examples of the outermost layer that can be used include single films such as a polyester film, a nylon film, and a polypropylene film, and laminated films of two or more types of these films. An example of a polyester film is a polyethylene terephthalate (PET) film. The outermost layer may be a transparent vapor deposited film. An example of a polypropylene film is a biaxially stretched polypropylene film (OPP: oriented polypropylene).

Examples of the sealant layer that can be used include low density polyethylene films, linear low density polyethylene films, medium density polyethylene films, high density polyethylene films, polypropylene films, ethylene-α-olefin copolymer films, and ionomer films. A single layer or a coextruded film of two or more layers of these films may be used.

The sheet part 16, the sheet part 18, and the sheet part 20 may include an intermediate layer between the outermost layer and the sealant layer in order to improve the characteristics of the pouch 10, such as the drop resistance and the puncture resistance. The intermediate layer may be made of, for example, a material that has excellent tearability in the flow direction of the resin. Examples of the intermediate layer include low density polyethylene films, linear low density polyethylene films, nylon films, polyester films, and polypropylene films.

In the sheet part 16, the sheet part 18, and the sheet part 20, the inner surface of the outermost layer (surface on the innermost layer side) or at least one of the front surface or the rear surface of the intermediate layer may be printed with a pattern, product description text, or the like. In this case, the printed layer is preferably formed of a material that is suitable for printing.

The plurality of layers constituting the sheet part 16, the sheet part 18, and the sheet part 20 may be joined, for example, via an adhesive layer. An example of such an adhesive layer is a layer formed of an adhesive. Examples of the adhesive constituting the adhesive layer are liquid-curing urethane adhesives, polyester urethane adhesives, polyether urethane adhesives, acrylic adhesives, polyester adhesives, polyamide adhesives, and epoxy adhesives. When such an adhesive is used, the two layers that are joined by the adhesive layer are laminated by dry lamination or non-solvent lamination processing. The adhesive layer may be a thermoplastic resin such as a polyethylene resin or a polypropylene resin. In this case, the two layers that are joined by the adhesive layer may be laminated by extrusion lamination.

The layer configuration of the sheet part 16, the sheet part 18, and the sheet part 20 may be the same or different.

The sheet part 16 and the sheet part 18 are stacked such that the sealant layers face each other. The sheet part 20 is arranged on the bottom part 12 side of the pouch 10 with respect to the sheet part 16 and the sheet part 18. The sheet part 20 is sandwiched between the stacked sheet part 16 and sheet part 18 in a state where it is folded into a self-supporting shape (such as a gusset shape), such that the sealant layer is on the outside. For example, the sheet part 20 is inserted between the sheet part 16 and the sheet part 18 in a state where it is folded in half, such that the sealant layer is on the outside. In the open state before the contents 100 are accommodated in the pouch 10, an example of the vertical direction length L3 of the folded sheet part 20 is 25 mm or more and 60 mm or less.

The pouch 10 is formed by heat sealing the sheet part 16, the sheet part 18, and the sheet part 20. As shown in FIG. 1, in the open state, the pouch 10 has a bottom seal part 22, a pair of side seal parts 26, and a side seal part 28. As shown in FIG. 2, in the closed state, the pouch 10 further includes a top seal part 24. Therefore, in the closed state, the pouch 10 has the bottom seal part 22, the top seal part 24, the pair of side seal parts 26, and the side seal part 28. In FIGS. 1 and 2, the sealed locations are shown hatched to clearly indicate the sealed locations. As described below, the top seal part 24 is a seal part that is formed after the contents 100 are accommodated in the pouch 10 in the open state.

The bottom seal part 22 is a section in which the sheet part 20, which is inserted between the pair of sheet parts 16 and the sheet part 18 as mentioned above, the sheet part 16, and the sheet part 18 are heat sealed. An example of the seal strength of the bottom seal part 22 is 50 N/15 mm or more and 80 N/15 mm or less.

As shown in FIG. 2, the top seal part 24 is a portion of the pair of sheet parts 16 and 18 in which the edge part on the opposite side (the top part 14 side) to the bottom seal part 22 has been heat sealed. The top seal part 24 is formed by heat sealing the top part 14 side after accommodating the contents 100 in the pouch 10 in the open state. An example of the seal width (vertical direction length) W1 of the top seal part 24 (or a top seal planned region that is to become the top seal part 24) is 5 mm or more and 25 mm or less. Although the seal strength of the top seal part 24 is set according to the size of the pouch 10 and the conditions of the contents 100 (such as the type and amount of the contents), the normal recommended seal strength is 50 N/15 mm or more and 80 N/15 mm or less.

The pair of side seal parts 26 and 28 are formed on both sides of the stacked sheet part 16 and sheet part 18 in the horizontal direction. The pair of side seal parts 26 and 28 connect the bottom seal part 22 and the top seal part 24.

Of the pair of side seal parts 26 and 28, the side seal part 26 is a seal part that is positioned on the side edge 10*a* side of the pouch 10 in the horizontal direction. The side seal part 26 is formed by heat sealing the sheet part 16 and the sheet part 18 along the outer edge of the sheet part 16 (or the sheet part 18). An example of the seal width W2 (horizontal direction length) of the side seal part 26 is 3 mm or more and 15 mm or less.

Of the pair of side seal parts 26 and 28, the side seal part 28 is a seal part that is positioned on the opposite side to the side seal part 26 in the horizontal direction. The side seal part 28 of the present embodiment is configured such that the steam generated when the pouch 10 is heated is released to the outside. Specifically, the side seal part 28 includes a first upper seal part (first seal part) 30, a first lower seal part (second seal part) 32, and a steam releasing seal part 34.

The first upper seal part 30 is a portion of the side seal part 28 that is positioned near the top part 14. The first upper seal part 30 is formed by heat sealing the pair of sheet parts 16 and 18 along the outer edge of the sheet part 16 (or the sheet part 18). For example, the seal width W3 of the first upper seal part 30 is the same the example of the seal width W2 of the side seal part 26. In the present embodiment, although the seal width W3 is the same as the seal width W2, the seal width W3 may be different from the seal width W2. An example of the seal strength of the first upper seal part 30 is 50 N/15 mm or more and 80 N/15 mm or less.

The first lower seal part 32 is a portion of the side seal part 28 that is positioned nearer to the bottom part 12 than to the first upper seal part 30. The first lower seal part 32 is separated from the first upper seal part 30 in the vertical direction. Therefore, of the sheet parts 16 and 18, the region between the first lower seal part 32 and the first upper seal part 30 along the vertical direction is a non-sealed region that is not sealed. The first lower seal part 32 is formed by heat sealing the pair of sheet parts 16 and 18 along the outer edge of the sheet part 16 (or the sheet part 18). For example, the seal width W4 of the first lower seal part 32 is the same the example of the seal width W2 of the side seal part 26. For example, the seal strength of the first lower seal part 32 may be the same as that of the first upper seal part 30. The seal strength of the first lower seal part 32 may be the same as the seal strength of the first upper seal part 30 or may be different.

In the present embodiment, although the seal width W4 of the first lower seal part 32 is the same as the seal width W2 and the seal width W3, the seal width W4 may be different from at least one of the seal width W2 and the seal width W3. For example, the seal width W4 may be narrower than the seal width W3.

The steam releasing seal part 34 is a portion of the side seal part 28 that is provided to allow the steam generated when the pouch 10 is heated to be released. The steam releasing seal part 34 is arranged nearer to the top part 14 than to a region of the accommodation space S that is filled with the contents 100. The steam releasing seal part 34 is a portion that joins the first upper seal part 30 and the first lower seal part 32, and projects toward the accommodation space S side. Therefore, the side seal part 28 has a shape that is recessed toward the accommodation space S at the portion corresponding to the steam releasing seal part 34.

In the pouch 10, the region surrounded by the side edge 10*b* and the steam releasing seal part 34 of the pouch 10 (including the region between the first upper seal part 30 and the first lower seal part 32) is a non-sealed region 36 in which the sheet part 16 and the sheet part 18 are not sealed. Because the portion of the non-sealed region 36 that overlaps the side edge 10*b* is open, it functions as a steam vent 36*a*.

The steam releasing seal part 34 includes a peak part 38 on the accommodation space S side. The steam releasing seal part 34 is formed by heat sealing the sheet parts 16 and 18 in the shape of the steam releasing seal part 34. In an embodiment, the seal strength of the steam releasing seal part 34 is lower than the seal strength of the first upper seal part 30, the first lower seal part 32, and the side seal part 26 so that steam is easily released from the steam releasing seal part 34. An example of the seal strength of the steam releasing seal part 34 is 25 N/15 mm or more and 50 N/15 mm or less. In an embodiment, the seal width of the steam releasing seal part 34 may be narrower than the seal width W3 of the first upper seal part 30 and the seal width W4 of the first lower seal part 32.

Figure 5:
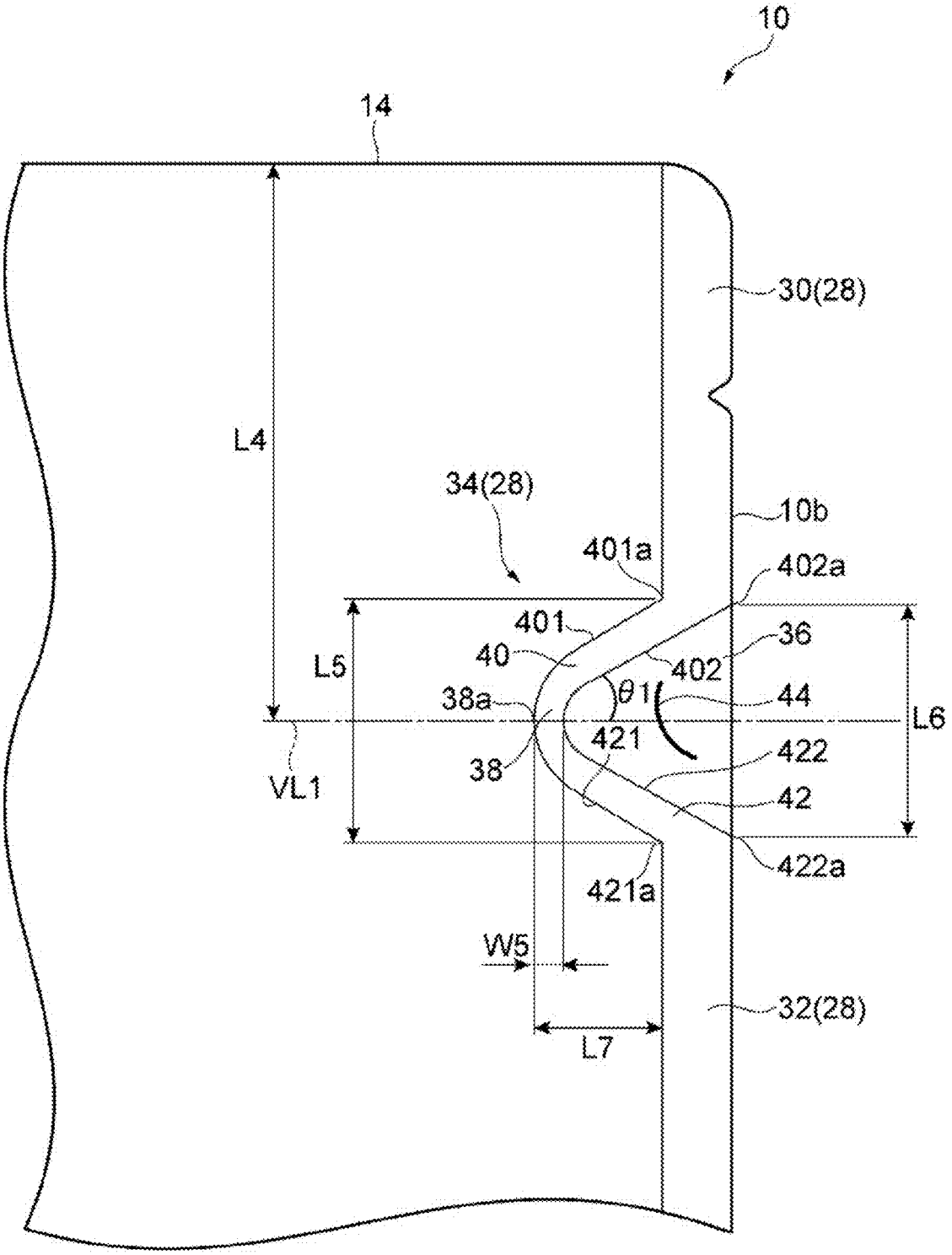
FIG. 5 is an enlarged view of the steam releasing seal part shown in FIG. 1.

The steam releasing seal part 34 will be further described with reference mainly to FIG. 5. FIG. 5 is an enlarged view of the steam releasing seal part 34. In FIG. 5, from the viewpoint of case of viewing the drawing, the hatching displayed in the seal locations in FIG. 1 and the like is omitted. The steam releasing seal part 34 includes the peak part 38 on the accommodation space S side, which is a seal part having a triangular shape (or a substantially letter-V shape). The steam releasing seal part 34 is symmetric with respect to a first virtual line VL1. The first virtual line VL1 is a virtual straight line that passes through the peak part 38 and extends in the horizontal direction. An example of the length LA between the outer edge of the top part 14 (the upper edge of the pouch 10) and the first virtual line VL1 is 25 mm or more and 70 mm or less.

The steam releasing seal part 34 includes a second upper seal part 40 that is connected to the first upper seal part 30, and a second lower seal part 42 that is connected to the first lower seal part 32. The connecting part between the second upper seal part 40 and the second lower seal part 42 is the peak part 38.

The second upper seal part 40 is positioned further toward the top part 14 side than to the first virtual line VL1. The second upper seal part 40 includes a first edge 401 on the accommodation space S side, and a second edge 402 on the non-sealed region 36 side. In the present embodiment, although the seal width of the second upper seal part 40 is substantially constant, the seal width may, for example, become narrower toward the peak part 38.

The second lower seal part 42 is positioned on the opposite side of the second upper seal part 40 with respect to the first virtual line VL1. The second lower seal part 42 includes a first edge 421 on the accommodation space S side, and a second edge 422 on the non-sealed region 36 side. The second lower seal part 42 is symmetrical to the second upper seal part 40 with respect to the first virtual line VL1. In the present embodiment, although the seal width of the second lower seal part 42 is substantially constant, the seal width may become narrower toward the peak part 38.

The second upper seal part 40 and the second lower seal part 42 are inclined with respect to the first virtual line VL1 (or the side edge 10*b* or the vertical direction), and the steam releasing seal part 34 has a spacing between the second upper seal part 40 and the second lower seal part 42 that widens from the peak part 38 toward the side edge 10*b*. An example of the inclination angle θ1 of the second upper seal part 40 (or the second lower seal part 42) with respect to the first virtual line VL1 is 15 degrees or more and 45 degrees or less. The inclination angle θ1 may be the angle between the second edge 402 and the first virtual line VL1.

An example of the length L5 between the end 401*a* of the first edge 401 of the second upper seal part 40 and the end 421*a* of the first edge 421 of the second lower seal part 42 is 5 mm or more and 55 mm or less. The end 401*a* is the end of the first edge 401 on the first upper seal part 30 side, and is a contact point with the first upper seal part 30. The end 421*a* is the end of the first edge 421 on the first lower seal part 32 side, and is a contact point with the first lower seal part 32.

An example of the length L6 between the end 402*a* of the second edge 402 of the second upper seal part 40 and the end 422*a* of the second edge 422 of the second lower seal part 42 is 5 mm or more and 55 mm or less. The end 402*a* is the end of the second edge 402 on the first upper seal part 30 side and is a contact point with the first upper seal part 30. The end 422*a* is the end of the second edge 422 on the first lower seal part 32 side and is a contact point with the first lower seal part 32.

The peak part 38 of the steam releasing seal part 34 may be rounded as shown in FIG. 5 (or in other words, may have a curved surface). If the peak part 38 is rounded, for example, the curvature radius of the edge of the peak part 38 on the accommodation space S side is 3 mm or more and 20 mm or less, and the curvature radius of the peak part 38 on the non-sealed region 36 side is 1.5 mm or more and 10 mm or less. An example of the seal width W5 of the steam releasing seal part 34 at the position of the peak part 38 (the seal width along the second virtual line VL2 described below) is 1.5 mm or more and 5 mm or less. An example of the length L7 between a front end 38*a* of the steam releasing seal part 34 on the accommodation space S side (the end of the peak part 38 that is most toward the accommodation space S side) and the side edge 10*b* is 5 mm or more and 20 mm or less.

The non-sealed region 36 that is surrounded by the steam releasing seal part 34 is formed having a penetration part 44 that penetrates each of the sheet part 16 and the sheet part 18 in the thickness direction (a direction that is orthogonal to the vertical direction and the horizontal direction). The penetration part 44 can be formed, for example, by making an incision (or a slit) in the sheet part 16 and the sheet part 18 with a blade having the shape of the penetrating part 44, or by cutting out the sheet part 16 and the sheet part 18.

The penetration part 44 will be described using FIG. 6. The penetration part 44 includes a first end 441 and a second end 442. The second end 442 is the end on the opposite side to the first end 441. The penetration part 44 may satisfy at least one of the following conditions (1) to (5).

Condition (1): The penetration part 44 is non-linear.

The non-linear penetration part 44 has a curved portion or a corner part. In other words, the penetration part 44 has a shape in which a gap exists between the region between the first end 441 and the second end 442 of the penetration part 44 and the second virtual line VL2. As shown in FIG. 6, the second virtual line VL2 is a virtual straight line that connects the first end 441 and the second end 442.

An example of the non-linear penetration part 44 is an arc shaped penetration part. Examples of the arc shape include a circular arc shape such as that shown in FIG. 6, a half-moon shape, and a crescent shape. The penetration part 44 may be letter-U shaped (or square-cornered shaped), or letter-V shaped. An example of the curvature radius of the arc shaped penetration part 44 is 2.5 mm or more and 10 mm or less.

An example of the length L8 between the first end 441 and the second end 442 is 3.5 mm or more and 14 mm or less. The length L8 is the length along the second virtual line VL2.

Condition (2): A part of the penetration part 44 is on the first virtual line VL1 that passes through the peak part 38 (more specifically, the front end 38*a*) of the steam releasing seal part 34. That is, the penetration part 44 has at least one intersection point with the first virtual line VL1.

Condition (3): A part of the penetration part 44 is located further toward the accommodation space S side than to a third virtual line VL3 that extends an edge of the first upper seal part 30 and the first lower seal part 32 that is positioned most toward the accommodation space S side. Specifically, a part of the penetration part 44 exists further toward the accommodation space S side than to the third virtual line VL3 that extends, of an inner edge 301 of the first upper seal part 30 on the accommodation space S side and an inner edge 321 of the first lower seal part 32 on the accommodation space S side, the edge that is positioned more toward the accommodation space S side. In the form illustrated in FIG. 6, because the extension line of the inner edge 301 and the extension line of the inner edge 321 coincide with each other, the third virtual line VL3 is the extension line of the inner edge 301 (or the inner edge 321).

Condition (4): The penetration part 44 is arranged inside a similar region 37 that is enclosed by the broken line in FIG. 6.

The similar region 37 is a region that is similar to the non-sealed region 36, and is a region having one quarter or more and two thirds or less the area of the non-sealed region 36. Because the non-sealed region 36 has a triangular shape, the similar region 37 has a triangular shape, and includes a peak part 37*a*. The peak part 37*a* is positioned on the first virtual line VL1. In the similar region 37, the bottom side that opposes the peak part 37*a* may coincide with the side edge 10*b* or may be separated from the side edge 10*b*.

Condition (5): The penetration part 44 is formed such that a virtual line that extends the penetration part 44 from the first end 441 or the second end 442, or a tangent line at the position of the first end 441 or the second end 442 does not extend further toward the lower side or the accommodation space S side than to the second virtual line VL2. The virtual line that extends the penetration part 44 from the first end 441 is a virtual line that extends the penetration part 44 from the first end 441 along the penetration part 44 that extends from the second end 442 to the first end 441, and as shown in FIG. 6, is a line that extends the circular arc when the penetration part 44 has a circular arc shape. Similarly, the virtual line that extends the penetration part 44 from the second end 442 is a virtual line that extends the penetration part 44 from the second end 442 along the penetration part 44 that extends from the first end 441 to the second end 442.

Figure 6:
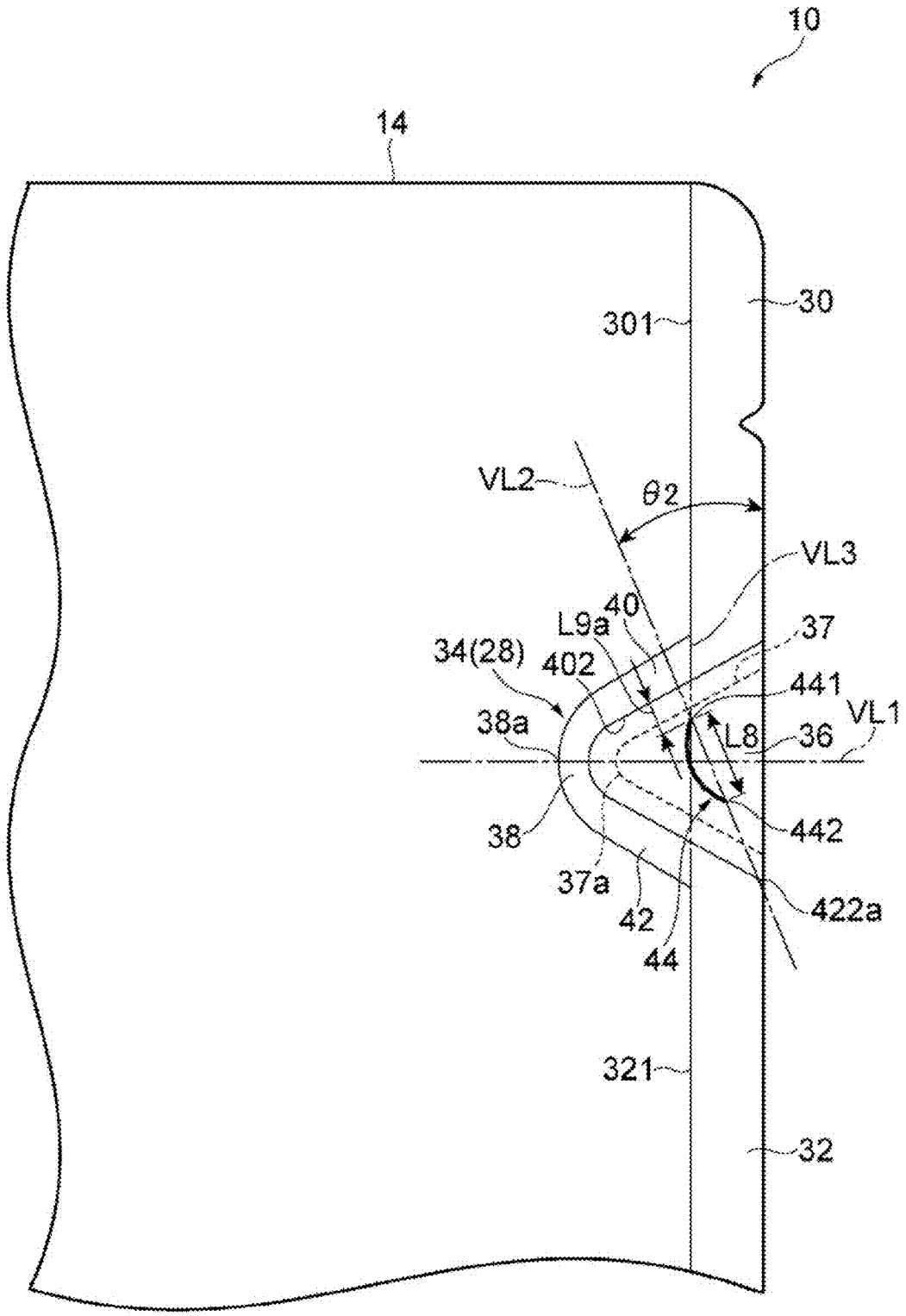
FIG. 6 is a diagram for describing the penetration part shown in FIGS. 1 and 5.

The penetration part 44 will be further described using the example of the penetration part 44 shown in FIG. 6. The penetration part 44 shown in FIG. 6 is an example of a case where all of conditions (1) to (5) are satisfied. The penetration part 44 shown in FIG. 6 has the second virtual line VL2 passing through the end 422*a* and is formed so as to form an angle θ2 with the side edge 10*b* (or the vertical direction). For example, the angle θ2 is +10 degrees or more and +45 degrees or less. In the present embodiment, the angle θ2 is set such that "positive" is in an anticlockwise direction, and "negative" is in a clockwise direction with respect to the vertical direction (the extending direction of the side edge 10*b*). For example, in the form shown in FIG. 6, when the absolute value of the angle θ2 is 25 degrees, the angle θ2 is +25 degrees.

In the penetration part 44 shown in FIG. 6, the first end 441 is separated from the second edge 402. An example of the length L9*a* between the first end 441 and the second edge 402 (the length along the second virtual line VL2) is 0.5 mm or more and 6 mm or less.

As mentioned above, the penetration part 44 shown in FIG. 6 is an example. Therefore, the arrangement state and the like of the penetration part 44 is not limited to the form shown in FIG. 6.

In an embodiment, as shown in FIGS. 1 and 2, at least one of the pair of side seal parts 26 and 28 is formed having a notch n near the top seal part 24. The notch n is a cut-out for opening the pouch 10 after heating the contents 100.

For example, the pouch 10 can be manufactured as follows.

The pair of sheet parts 16 and 18 are stacked such that the sealant layers face each other. As mentioned above, the sheet part 20, which has the sealant layer positioned on the outside and is folded into a self-supporting shape, is sandwiched between the stacked pair of sheet parts 16 and 18. In this state, by heat sealing the sheet parts 16, 18 and 20, the bottom seal part 22 and the pair of side seal parts 26 and 28 are formed. Then, the penetration part 44 is formed in the non-sealed region 36 provided on the side seal part 28 side. As a result, the open state pouch 10 is obtained.

In the open state pouch 10, the top part 14 is open. Therefore, the contents 100 are accommodated in the accommodation space S from the opening. Then, the top seal part 24 is formed by heat sealing the top part 14. As a result, the closed state pouch 10 is obtained.

The process of forming the penetration part 44 is not limited to being performed after forming the bottom seal part 22 and the pair of side seal portions 26 and 28 as described above. The penetration part 44 may be formed at any stage before accommodating the contents 100 in the accommodation space S. For example, the sheet part 16 and the sheet part 18 may be prepared having the penetration part 44 formed in advance.

When the pouch 10 has the notch n, the notch n can be formed at any stage before the contents 100 are accommodated in the accommodation space S. For example, the pouch 10 may be manufactured by preparing the sheet part 16 and the sheet part 18 formed having the notch n.

Next, the working effects of the pouch 10 will be described.

When an end user (consumer) purchases the pouch 10 and eats the contents 100 inside the pouch 10, the pouch 10 is heated, for example, in a microwave oven. When the internal pressure inside the pouch 10 increases due to the steam generated inside the pouch 10 due to the heating, the triangular shaped steam releasing seal part 34 is detached starting from the peak part 38. As a result, because the non-sealed region 36 and the accommodation space S become connected, the steam is discharged to the outside of the pouch 10 via the non-sealed region 36 (more specifically, from the steam vent 36*a*). At this time, depending on the state of increase in the internal pressure of the pouch 10, the steam vent 36*a* may become closed or the steam flow path of the steam vent 36*a* may become narrow. Even in such a case, because the pouch 10 has the penetration part 44, it is possible for steam to be discharged from the penetration part 44. Therefore, it is possible to suppress unnecessary increase in the internal pressure of the pouch 10 during heating.

If the penetration part is not formed in the non-sealed region and the steam vent 36*a* is blocked or becomes narrow, the internal pressure of the pouch will become higher than anticipated at the manufacturing stage of the pouch. In this way, when the internal pressure increases more than anticipated, the sealed locations other than the steam releasing seal part may become detached. In anticipation of circumstances such as those described above during manufacturing of the pouch, the seal strength of the side seal part and the bottom seal part that is employed is at a level such that retraction substantially does not occur even under the circumstances described above.

On the other hand, the content manufacturer that manufactures the contents normally purchases the open state pouch from the pouch supplier and seals the top part after accommodating the contents inside the pouch. That is, the pouch supplier and the company that forms the top seal part by sealing the top part are different. The recommended seal strength is set such that, as long as the top part is sealed at the seal strength that is recommended by the pouch supplier, the detachment amount (retraction amount) of the top seal part is suppressed to a certain range or below, even when the circumstances described above occur. However, a case may also occur in which the top part is sealed at a lower seal strength than the range anticipated by the pouch supplier, which is a lower seal strength than the recommended seal strength mentioned above. In this case, as mentioned above, when the internal pressure of the pouch increases due to the opening (steam vent) in the pouch side edge, which is formed by the sealed region, becoming closed or narrow, there is a concern that the top seal part may become detached, causing the contents to spill out.

If the opening (steam vent) in the pouch side edge formed by the sealed region becomes narrow, steam will forcefully blow out from the opening. Therefore, the arrangement state of the pouch becomes unstable due to rotation of the pouch and the like during heating. As a result, there is a concern that the pouch may fall over during heating.

In contrast, in the pouch 10, it is possible to discharge steam from the penetration part 44 even in a case where the steam vent 36*a* has closed or in a case where the flow path of the steam in the steam vent 36*a* has become narrow. Therefore, as mentioned above, unnecessary increase in the internal pressure of the pouch 10 can be suppressed. As a result, even if the top part 14 is sealed at a seal strength that is lower than the recommended seal strength, detachment (retraction) of the top seal part 24 can be suppressed during heating of the pouch 10, and it is possible to prevent the contents 100 from bursting out from the top part 14. Further, because steam can also be released from the penetration part 44, it is difficult for rotation of the pouch 10 such as that mentioned above to occur, and with the configuration of the pouch 10, it is possible to prevent the pouch 10 from falling over during heating.

When the penetration part 44 satisfies at least one of the conditions (1) to (3) above, it is difficult for the rotation described above to occur.

When the penetration part 44 satisfies condition (4) above, the penetration part 44 is formed at a certain distance from the steam releasing seal part 34. In this case, as a result of steam being discharged from the penetration part 44, even if a breakage occurs in part of the sheet part 16 (or the sheet part 18) near the penetration part 44, it is difficult for the breakage location to reach the steam releasing seal part 34, and in particular, the region of the steam releasing seal part 34 that does not detach and maintains the sealed state. As a result, it is possible to prevent the contents 100 from spilling out from the steam releasing seal part 34 and the vicinity thereof.

When the penetration part 44 satisfies condition (5) above, as a result of steam being discharged from the penetration part 44, even when a breakage occurs in part of the sheet part 16 (or the sheet part 18) near the penetration part 44, it is difficult for the breakage to progress toward the center of the accommodation space S or to the contents 100 side. As a result, even when such a breakage occurs, it is possible to prevent the contents 100 from spilling out from the breakage location.

As described in the present embodiment, in a form in which the penetration part 44 is formed in both the sheet part 16 and the sheet part 18, it is possible for steam to be released from the penetration part 44 formed in each of the sheet part 16 and the sheet part 18. As a result, an unnecessary increase in the internal pressure in the pouch 10 can be suppressed. In addition, it is difficult for rotation to occur because steam is discharged from both the sheet part 16 and the sheet part 18.

Although an embodiment of the present invention has been described above, the present invention is not limited to the embodiment above and includes the scope indicated by the claims, and it is intended that all changes within the meaning and range of equivalents of the claims be included.

The illustrated embodiments and modifications may be combined with each other without departing from the spirit of the present invention.

EXAMPLES

Hereinafter, the present invention will be described in detail using examples. However, the present invention is not limited to the examples described below. For convenience of description, the same constituent elements as the constituent elements in the embodiment described above will be given the same reference signs, and duplicate descriptions will be omitted.

Example 1

Figure 7:
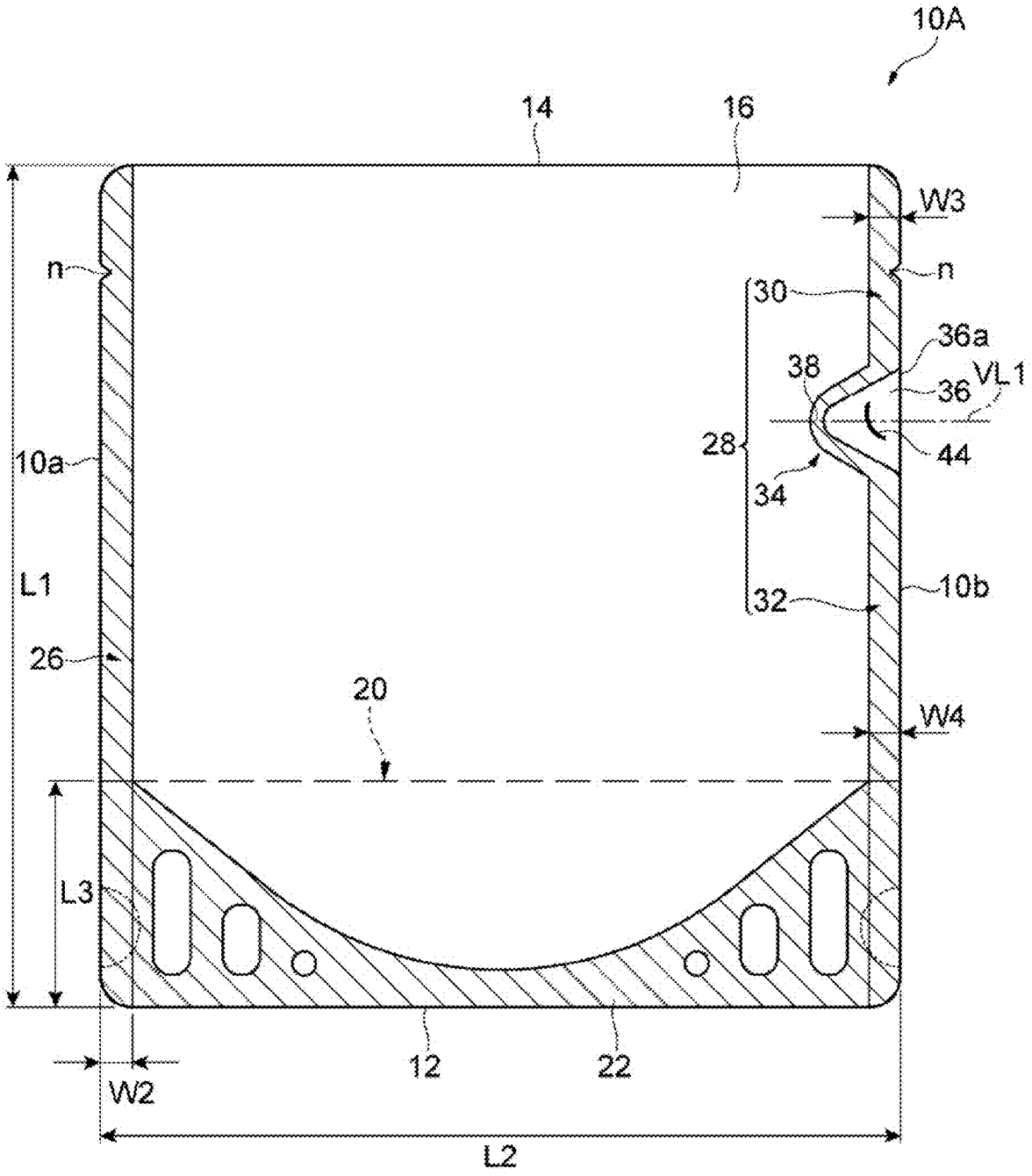
FIG. 7 is a plan view of a pouch according to Example 1.

The pouch 10A shown in FIG. 7 was produced as the pouch of Example 1. FIG. 7 is a diagram for describing the pouch of Example 1. In FIG. 7, similarly to FIGS. 1 and 2, the sealed locations are shown hatched to clearly indicate the sealed locations. The pouch 10A corresponded to the pouch 10 shown in FIG. 1, and included the steam releasing seal part 34, the non-sealed region 36, and the penetration part 44 described using FIGS. 5 and 6.

The sheet part 16, the sheet part 18, and the sheet part 20 were prepared in order to produce the pouch 10A. The sheet part 16, the sheet part 18, and the sheet part 20 were the same laminated sheet having the following layer structure.

<Layer Configuration>

Outer Film/Printed Layer/Intermediate Film/Sealant Layer

The outer film was the outermost layer in the layer configuration described above and was a transparent vapor-deposited PET film (GL-ARH, manufactured by Toppan Printing Co., Ltd.) having a thickness of 12 μm.

The printed layer was formed using LioGran, manufactured by Toyo Ink Co., Ltd.

The intermediate film was a nylon film (NAP22, manufactured by Toyobo Co., Ltd.) having a thickness of 15 μm.

The sealant layer was a non-axially stretched polypropylene film (ZK207, manufactured by Toray Film Kako Co., Ltd.) having a thickness of 60 μm.

The sheet part 16, the sheet part 18, and the sheet part 20 were heat sealed in a state where the sealant layers of the sheet part 16 and the sheet part 18 were facing each other, and the sheet part 20 was inserted therebetween so as to form the bottom part 12 of the pouch 10A. At this time, the heat sealing was performed so as to form the steam releasing seal part and the non-sealed region as shown in FIG. 1. Further, the pouch 10A was prepared by forming the penetration part 44 in the sheet part 16 and the sheet part 18 using a cutter. The notch n was formed in each of the side seal part 26 and the side seal part 28 of the pouch 10 at a position 20 mm from the outer edge of the top part 14.

The dimensions of the pouch 10A were as follows. As mentioned above, the pouch 10A was the same as the pouch 10 of the form shown in FIG. 1, and included the steam releasing seal part 34 and the penetration part 44 described using FIGS. 5 and 6. Therefore, the description relating to the steam releasing seal part 34 and the penetration part 44 is based on FIGS. 5 and 6.

(1) Dimensions Relating to Outer Shape of Pouch 10A
- Vertical direction length L1: 158 mm
- Horizontal direction length L2: 150 mm
- Vertical direction length L3 of bottom part 12: 42.5 mm
- Seal width W2 of side seal part 26: 6 mm
- Seal width W3 of first upper seal part 30 of side seal part 28: 6 mm
- Seal width W4 of first lower seal part 32 of side seal part 28: 6 mm (2) Dimensions Relating to Steam Releasing Seal Part 34 (see FIG. 5)
- Length LA from outer edge of top part 14 to second virtual line VL2: 48 mm
- Length L5 between end 401*a* and end 421*a*: 21 mm
- Length L6 between end 402*a* and end 422*a*: 20 mm
- Curvature radius of edge of peak part 38 on accommodation space S side: 7 mm
- Curvature radius of edge of peak part 38 on non-sealed region 36 side: 3.5 mm
- Length L7 between peak part 38 (front end 38*a*) and side edge 10*b*: 17 mm
- Seal width W5 of steam releasing seal part at position of peak part 38 (front end 38*a*): 2.5 mm (3) Dimensions Relating to Penetration Part 44 (see FIG. 6)
- Curvature radius of penetration part 44: 5 mm
- Length L8 of first end 441 and second end 442: 7.07 mm The penetration part 44 having the above size corresponds to one quarter of the circumference of a circle with a radius of 5 mm. The penetration part 44 had the first end 441 and the second end 442 positioned on the second virtual line VL2, which passed through the end 442*a* and formed an angle θ2 with the side edge 10*b* (vertical direction) of +25 degrees, and the non-sealed region 36 was arranged such that the length L9*a* between the first end 441 and the intersection between the second virtual line VL2 and the second edge 402 was 3 mm.

In the pouch 10A, the seal strength of the side seal part 26, the first upper seal part 30, and the first lower seal part 32 was 55 N/15 mm, and the seal strength of the steam releasing seal part 34 was 35 N/15 mm.

The penetration part 44 satisfied all of the conditions (1) to (5) described in the embodiment above.

Pouch of Example 2

Figure 8:
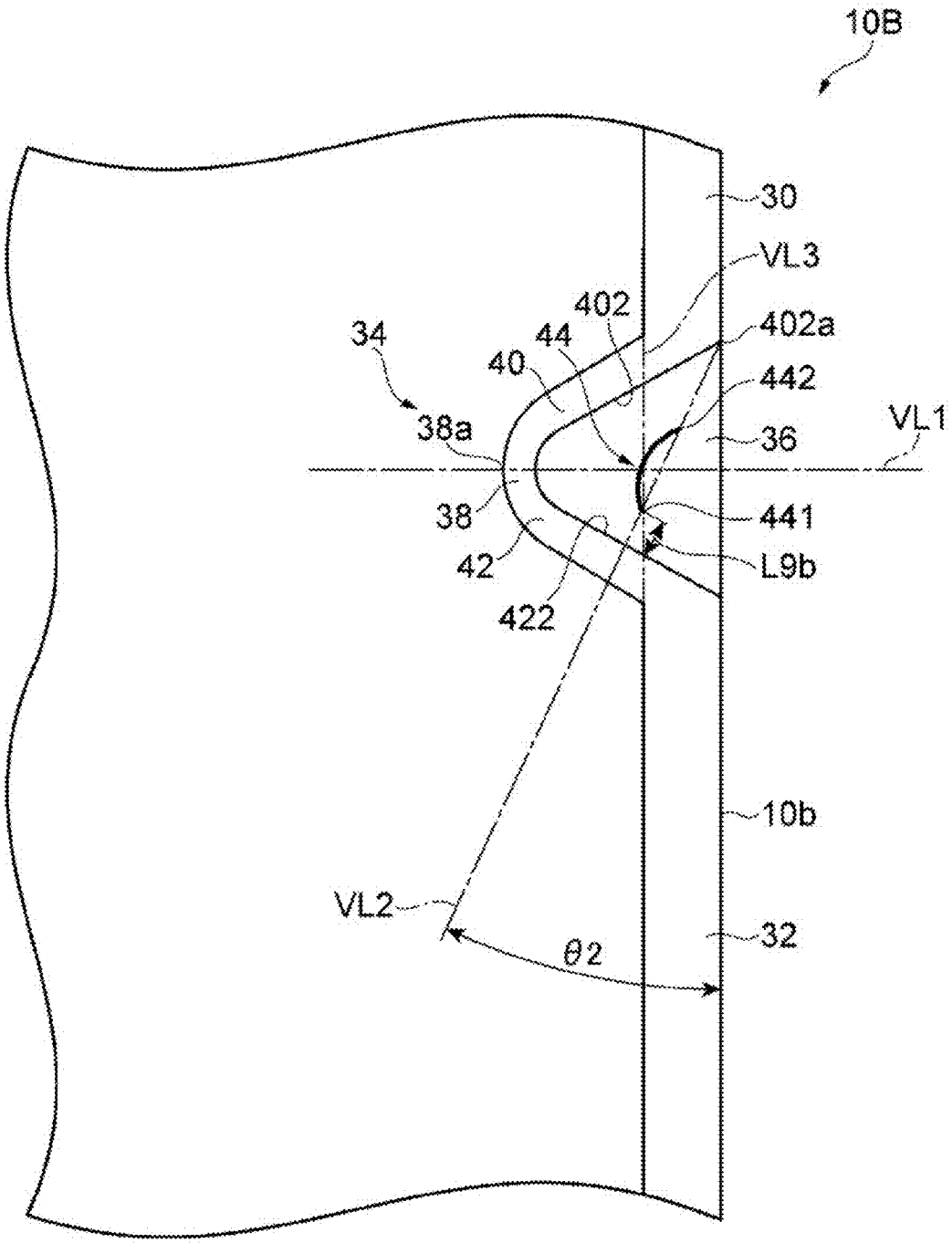
FIG. 8 is an enlarged view of the vicinity of a penetration part provided in a pouch according to Example 2.

As the pouch of Example 2, as shown in FIG. 8, a pouch 10B was produced having the same configuration as the pouch 10A, except for a difference in the arrangement of the penetration part 44 of the pouch 10A. FIG. 8 is a partially enlarged view of the pouch 10B. The penetration part 44 of the pouch 10B is formed by inverting the penetration part 44 of the pouch 10A with respect to the first virtual line VL1. Therefore, the shape of the penetration part 44 (the curvature radius and the length L8 (see FIG. 6)) was the same as the case of the pouch 10A.

In the penetration part 44 of the pouch 10B, the second virtual line VL2 passed through the end 402, the angle θ2 between the side edge 10*b* and the second virtual line VL2 was −25 degrees, and the non-sealed region 36 was arranged such that the length L9*b* between the first end 441 and the intersection between the second virtual line VL2 and the second edge 422 was 3 mm. The penetration part 44 was positioned on the upper side with respect to the second virtual line VL2 and protruded toward the top part 14 side.

The penetration part 44 of the pouch 10B satisfied all of the conditions (1) to (5) described in the embodiment above.

Pouch of Example 3

Figure 9:
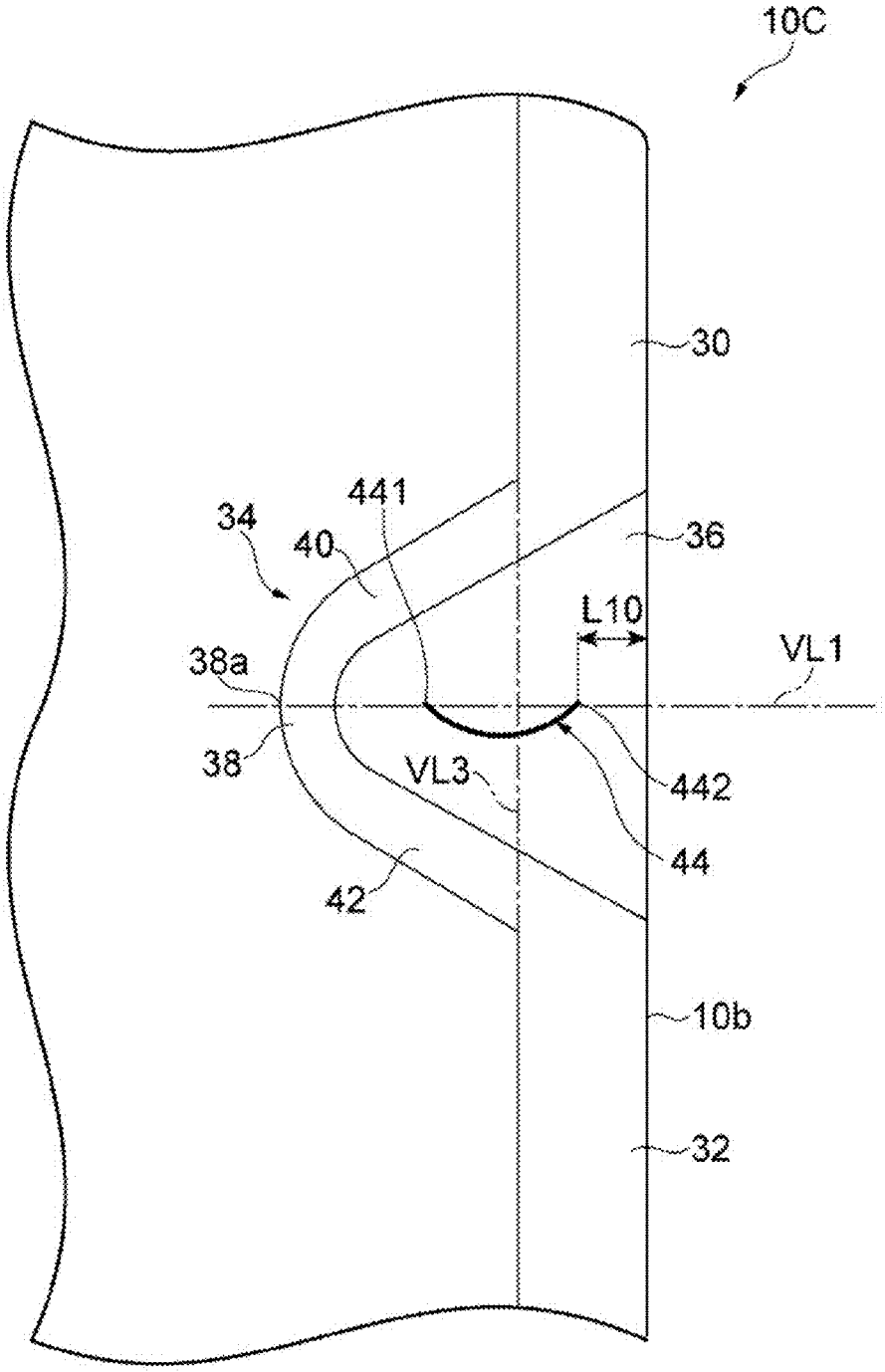
FIG. 9 is an enlarged view of the vicinity of a penetration part provided in a pouch according to Example 3.

As the pouch of Example 3, as shown in FIG. 9, a pouch 10C was produced having the same configuration as the pouch 10A, except for a difference in the arrangement of the penetration part 44 of the pouch 10A. FIG. 9 is a partially enlarged view of the pouch 10C. The shape of the penetration part 44 of the pouch 10C (the curvature radius and the length L8 (see FIG. 6)) was the same as the case of the pouch 10A. The penetration part 44 of the pouch 10C had the first end 441 and the second end 442 positioned on the first virtual line VL1 and was arranged on the lower side with respect to the first virtual line VL1. Therefore, the penetration part 44 of the pouch 10C protruded toward the lower side. The length L10 between the second end 442 and the side edge 10*b* was 3 mm.

The penetration part 44 of the pouch 10C satisfied all of the conditions (1) to (5) described in the embodiment above.

Pouch of Example 4

Figure 10:
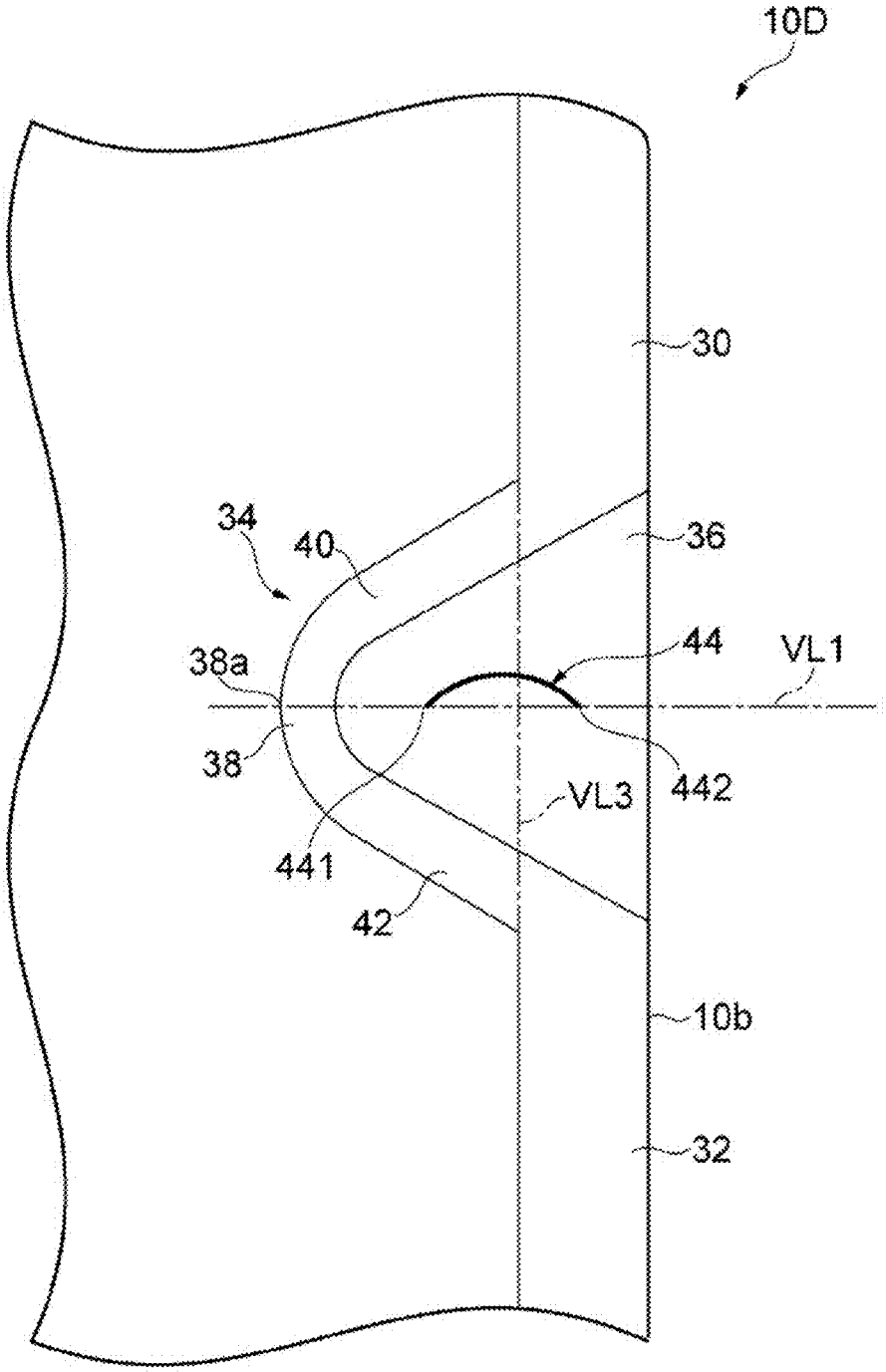
FIG. 10 is an enlarged view of the vicinity of a penetration part provided in a pouch according to Example 4.

As the pouch of Example 4, as shown in FIG. 10, a pouch 10D was produced having the same configuration as the pouch 10A, except for a difference in the arrangement of the penetration part 44 of the pouch 10A. FIG. 10 is a partially enlarged view of the pouch 10D. The shape of the penetration part 44 of the pouch 10D (the curvature radius and the length L8 (see FIG. 6)) was the same as the case of the pouch 10A. The penetration part 44 of the pouch 10D was arranged such that the penetration part 44 of the pouch 10C was inverted with respect to the first virtual line VL1. Therefore, the penetration part 44 was arranged on the lower side with respect to the first virtual line VL1.

The penetration part 44 of the pouch 10C satisfied the conditions (1) to (4) described in the embodiment above.

Pouch of Example 5

Figure 11:
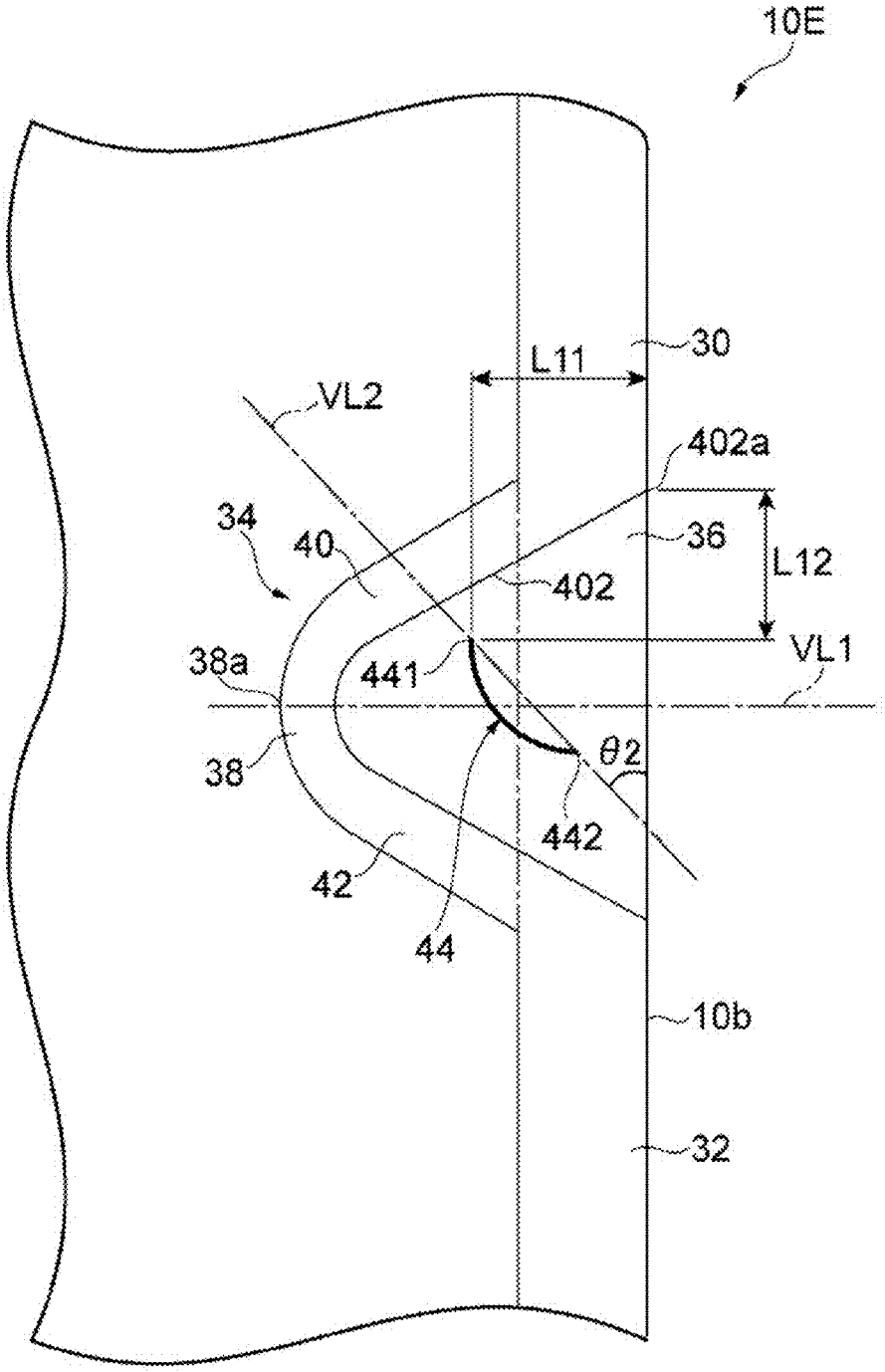
FIG. 11 is an enlarged view of the vicinity of a penetration part provided in a pouch according to Example 5.

As the pouch of Example 5, as shown in FIG. 11, a pouch 10E was produced having the same configuration as the pouch 10A, except for a difference in the arrangement of the penetration part 44 of the pouch 10A. FIG. 11 is a partially enlarged view of the pouch 10E. The shape of the penetration part 44 of the pouch 10E (the curvature radius and the length L8 (see FIG. 6)) was the same as the case of the pouch 10A.

The first end 441 of the penetration part 44 of the pouch 10E was positioned at a length L11 from the side edge 10*b*, and positioned at a length L12 from the end 402*a*. The length L11 is a length along the horizontal direction, and was 9 mm. The length L12 is a length along the vertical direction, and was 9 mm. The angle θ2 between the second virtual line VL2 and the side edge 10*b* was +40 degrees. The penetration part 44 of the pouch E was arranged on the lower side with respect to the second virtual line VL2. Therefore, the penetration part 44 protruded toward the accommodation space S.

The penetration part 44 of the pouch 10E satisfied all of the conditions (1) to (5) described in the embodiment above.

Pouch of Example 6

Figure 12:
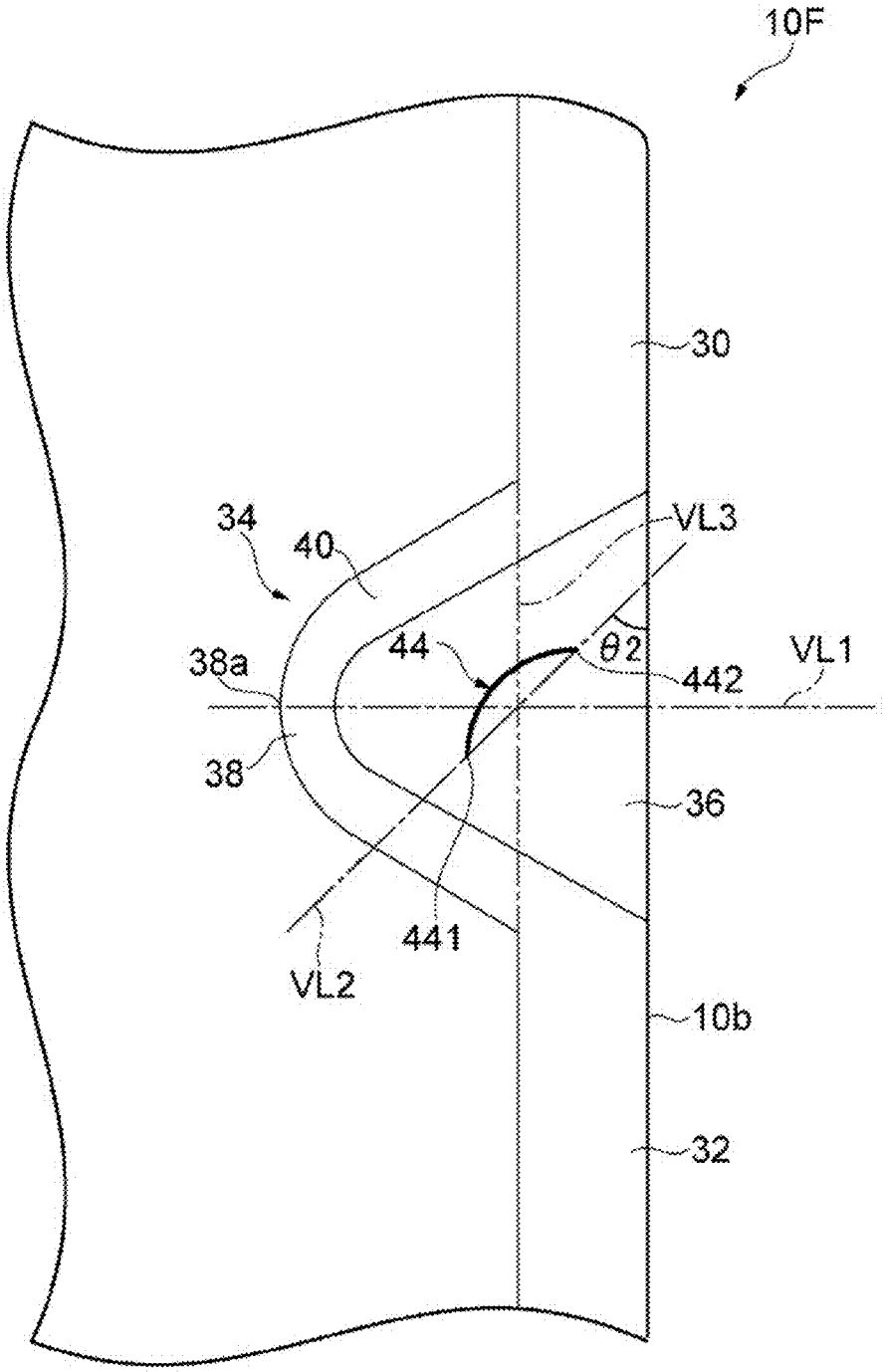
FIG. 12 is an enlarged view of the vicinity of a penetration part provided in a pouch according to Example 6.

As the pouch of Example 6, as shown in FIG. 12, a pouch 10F was produced having the same configuration as the pouch 10A, except for a difference in the arrangement of the penetration part 44 of the pouch 10A. FIG. 12 is a partially enlarged view of the pouch 10F. The shape of the penetration part 44 of the pouch 10F (the curvature radius and the length L8 (see FIG. 6)) was the same as the case of the pouch 10A.

The penetration part 44 of the pouch 10F was arranged such that the penetration part 44 of the pouch 10E was inverted with respect to the first virtual line VL1. Therefore, the angle θ2 between the second virtual line VL2 and the side edge 10*b* was −45 degrees. The penetration part 44 of the pouch 10E was arranged on the upper side with respect to the second virtual line VL2.

The penetration part 44 of the pouch 10F satisfied the conditions (1) to (4) described in the embodiment above.

Pouch of Example 7

Figure 13:
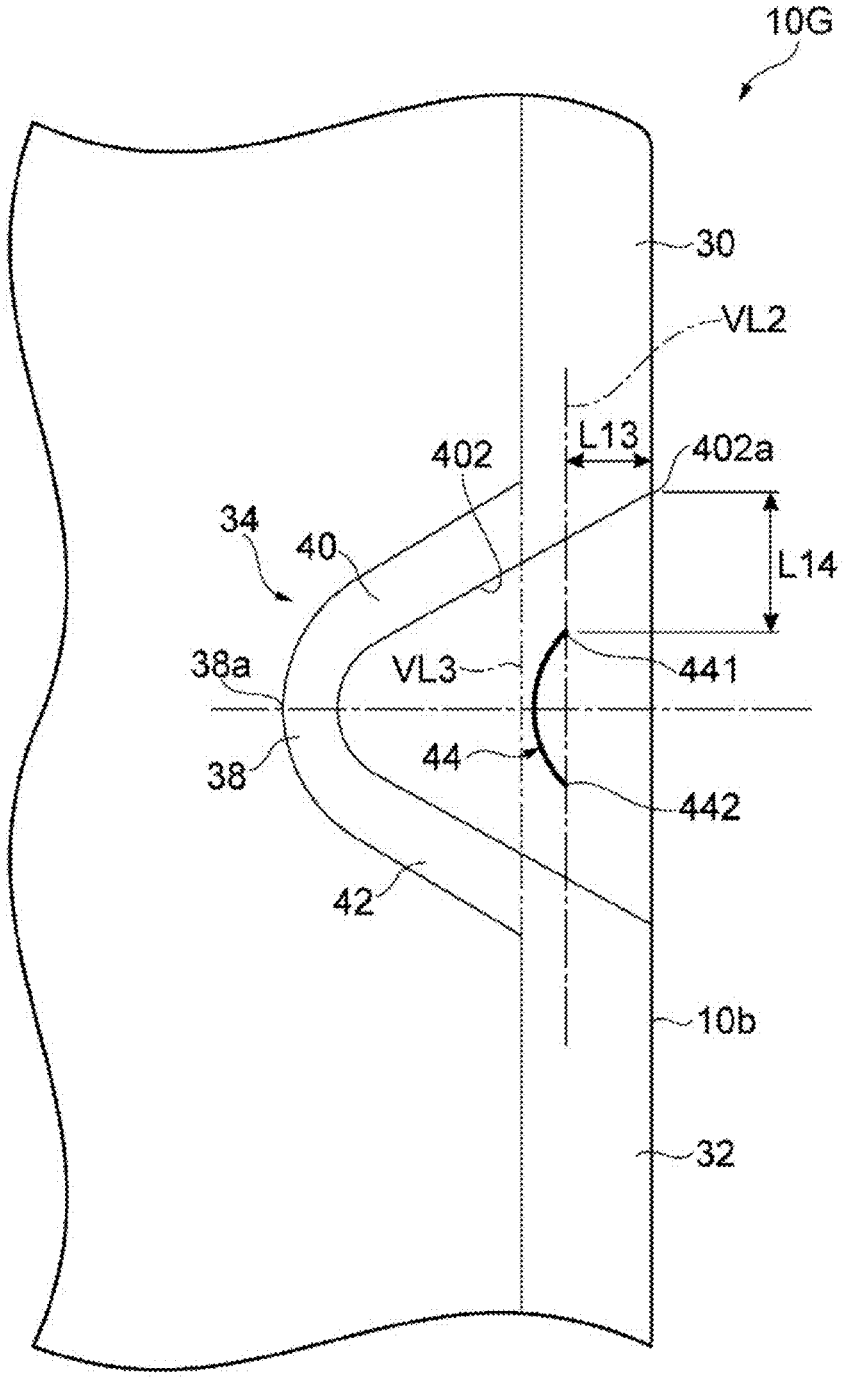
FIG. 13 is an enlarged view of the vicinity of a penetration part provided in a pouch according to Example 7.

As the pouch of Example 7, as shown in FIG. 13, a pouch 10G was produced having the same configuration as the pouch 10A, except for a difference in the arrangement of the penetration part 44 of the pouch 10A. FIG. 13 is a partially enlarged view of the pouch 10G. The shape of the penetration part 44 of the pouch 10G (the curvature radius and the length L8 (see FIG. 6)) was the same as the case of the pouch 10A.

The pouch 10G was arranged such that the second virtual line VL2 was parallel with the side edge 10*b*. The length L13 between the second virtual line VL2 and the side edge 10*b* (the length in the horizontal direction) was 3 mm. The first end 441 was positioned at a length L14 from the end 402*a*. The length L12 is a length along the vertical direction, and was 6.5 mm. The center of the penetration part 44 of the pouch 10G was positioned on the first virtual line VL1. The pouch 10G was positioned further toward the side edge 10*b* side (outside) than to the third virtual line VL3.

The penetration part 44 of the pouch 10G satisfied the conditions (1), (2), (4) and (5) described in the embodiment above.

Pouch of Example 8

Figure 14:
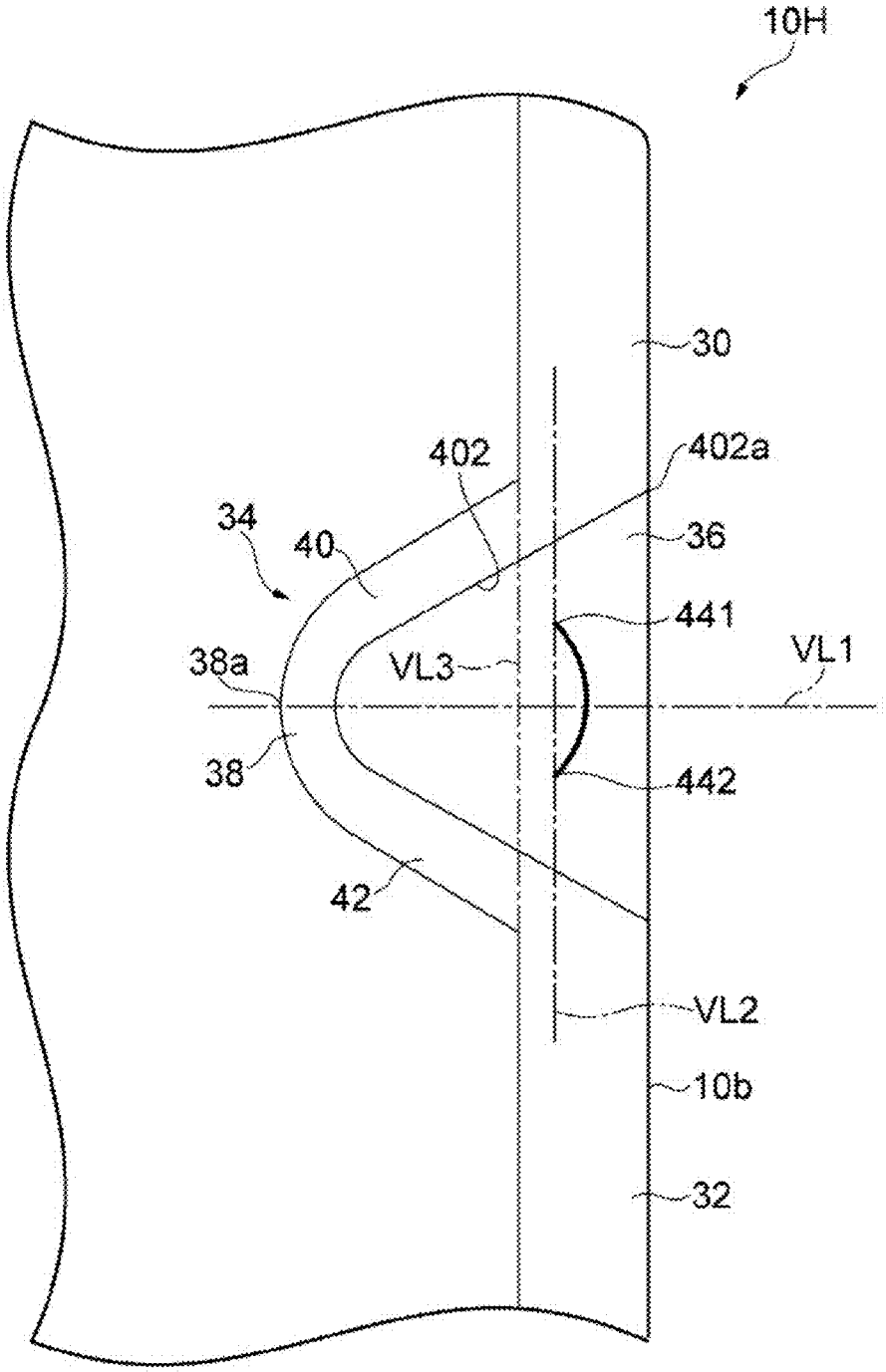
FIG. 14 is an enlarged view of the vicinity of a penetration part provided in a pouch according to Example 8.

As the pouch of Example 8, as shown in FIG. 14, a pouch 10H was produced having the same configuration as the pouch 10A, except for a difference in the arrangement of the penetration part 44 of the pouch 10A. FIG. 14 is a partially enlarged view of the pouch 10H. The shape of the penetration part 44 of the pouch 10H (the curvature radius and the length L8 (see FIG. 6)) was the same as the case of the pouch 10A.

The pouch 10H was arranged such that the penetration part 44 of the pouch 10G was inverted with respect to the second virtual line VL2. The penetration part 44 of the pouch 10H was positioned further toward the side edge 10*b* side (outside) than the third virtual line VL3.

The penetration part 44 of the pouch 10H satisfied the conditions (1), (2) and (4) described in the embodiment above.

Pouch of Comparative Example 1

Figure 15:
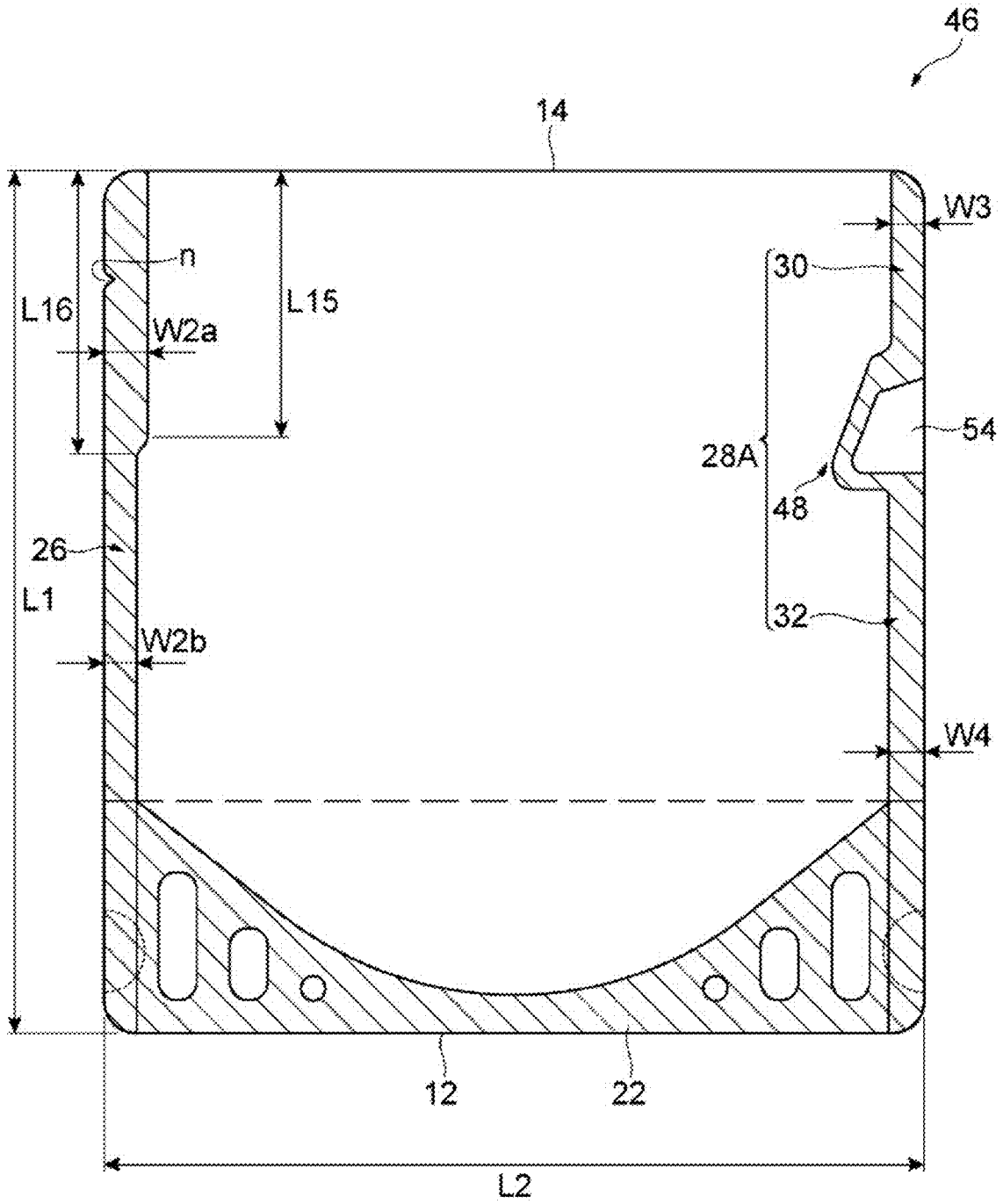
FIG. 15 is a plan view of a pouch according to Comparative Example 1.

The pouch 46 shown in FIG. 15 was produced as the pouch of Comparative Example 1. FIG. 15 is a diagram for describing the pouch of Comparative Example 1. In the description of the pouch 46, for convenience of the description, the same elements as those described in the embodiment above or in the pouch 10A will be given the same reference signs. Duplicate descriptions will be omitted.

The pouch 46 is different from the pouch 10A in the respect that the seal width of the side seal part 26 is not uniform, the notch n is only formed in the side seal part 26, the side seal part 28A is included instead of the side seal part 28, and no penetration part 44 is included.

Except for the differences mentioned above, the configuration of the pouch 46 is the same as that of the pouch 10A. Therefore, the pouch 46 includes the sheet part 16, the sheet part 18, and the sheet part 20 having the same layer configuration as the pouch 10A. Further, the vertical direction length L1 the horizontal direction L2, and the vertical direction length L3 of the bottom part 12 were the same as in the pouch 10A. The pouch 46 will be described below, focusing mainly on the differences mentioned above.

In the side seal part 26, the seal width W2*a* up to a position a length L15 (vertical direction length) from the outer edge of the top part 14 was 8 mm. In the side seal part 26, the seal width W2*b* from the position which is the length L16 (vertical direction length) from the outer edge of the top part 14 to the bottom part 12 was 6 mm. The length L16 was 52 mm. A step was formed between the region having the seal width W2*a* and the region having the seal width W2*b*.

The side seal part 28A is different from the side seal part 28 included in the pouch 10A (pouch 10) in the respect that a steam releasing seal part 48 is provided instead of the steam releasing seal part 34. That is, the side seal part 28A includes the first upper seal part 30, the first lower seal part 32, and the steam releasing seal part 48. The first upper seal part 30 and the first lower seal part 32 were the same as in the pouch 10A. Therefore, the seal width W3 of the first upper seal part 30 and the seal width W4 of the first lower seal part 32 were 6 mm.

Figure 16:
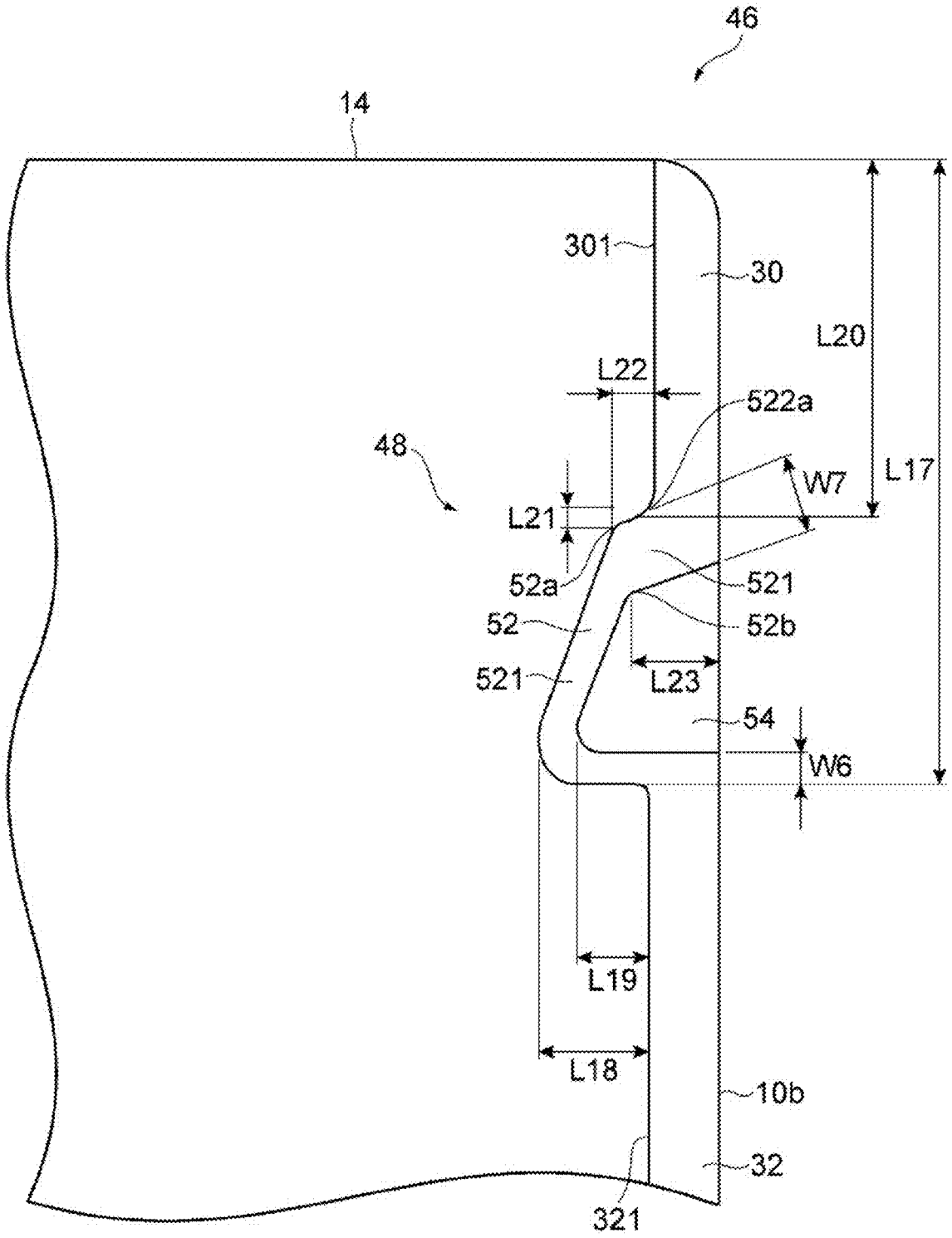
FIG. 16 is an enlarged view of a steam releasing seal part provided in the pouch shown in FIG. 15.

The steam releasing seal part 48 will be described using FIG. 16. The steam releasing seal part 48 includes a second lower seal part 50 and a second upper seal part 52. FIG. 16 is an enlarged view of the steam releasing seal part provided in the pouch shown in FIG. 15. In FIG. 16, from the viewpoint of case of viewing the drawing, the hatching of the seal locations shown in FIG. 15 is omitted. In the pouch 46, the region surrounded by the steam releasing seal part 48 was a non-sealed region 54.

As shown in FIG. 16, the second lower seal part 50 is a portion that is connected to the first lower seal part 32 and is formed along the horizontal direction. The length L17 between the lower edge of the second lower seal part 50 and the outer edge of the top part 14 was 58 mm. The seal width W6 of the second lower seal part 50 was 3 mm.

The second upper seal part 52 is a portion that connects the end portion of the second lower seal part 50 on the accommodation space S side and the first upper seal part 30. The connection part (corner part) between the second upper seal part 52 and the second lower seal part 50 was rounded. The curvature radius of the edge of the connection part on the accommodation space S side was 4.5 mm, and the curvature radius of the edge on the non-sealed region 54 side was 2 mm. The length L18 (horizontal direction length) between the position of the edge of the connection part on the accommodation space S side that is most toward the center side of the pouch 46 and the inner edge 321 of the first lower seal part 32 was 10 mm. The length L19 (horizontal direction length) between the position of the edge of the connection part on the non-sealed region 54 side that is most toward the center side of the pouch 46 and the inner edge 321 was 7 mm.

The second upper seal part 52 includes a first region 521 that is connected to the second lower seal part 50, and a second region 522 that is connected to the first upper seal part 30. The length L20 (vertical direction length) between the connection point 522*a* of the connection part between the second region 522 and the first upper seal part 30 on the accommodation space S side and the outer edge of the top part 14 was 33.65 mm. The seal width W7 of the second region 522 at the position of the connection point 522*a* was 7.5 mm.

The first region 521 extends from the end part of the second lower seal part 50 on the accommodation space S toward the first upper seal part 30, and the first region 521 is inclined with respect to the horizontal direction. The second region 522 is a region between the first region 521 and the first upper seal part 30, and is inclined with respect to the horizontal direction. The inclination angle of the second region 522 with respect to the horizontal direction is smaller than the inclination angle of the first region 521 with respect to the horizontal direction. Therefore, the edge of the second upper seal part 52 on the accommodation space S side includes a bending point 52*a*, and the edge on the non-sealed region 54 side includes a bending point 52*b*. The length L21 (vertical direction length) between the bending point 52*a* and the connection point 522*a* was 0.65 mm. The length L22 between the bending point 52*a* and the inner edge 301 of the first upper seal part 30 was 3.37 mm. The length L23 between the bending point 52*b* and the side edge 10*b* was 8.18 mm.

In the pouch 46, the seal strength of the side seal part 26, the bottom seal part 22, the first upper seal part 30, the first lower seal part 32, and the steam releasing seal part 48 was the same as the seal strength of the corresponding locations in the pouch 10A.

Evaluation Relating to Retraction Amount (Retraction Margin) of Top Seal Part Evaluation Experiment I relating to the retraction amount of the top seal part was performed with respect to the pouch 10A, the pouch 10B, and the pouch 46 of Example 1, Example 2, and the Comparative Example. The method of Evaluation Experiment I will be described referring to the pouch 10A, the pouch 10B, and the pouch 46 as a pouch.

Evaluation Experiment I (a1) After accommodating 170 g of curry in the open state pouch, the top seal part was formed by heat sealing the top part. The seal width of the top seal part (the seal width W1 in FIG. 2) was 9 mm. At this time, the following three levels were set in terms of the seal strength of the top seal part, and pouches (pouches accommodating the curry) having the top seal part of each level were prepared.

Level 1:20 N/15 mm

Level 2:30 N/15 mm

Level 3:40 N/15 mm

The seal strengths represented by the three levels above were sufficiently lower than the lower limit of the seal strength of the top seal part of 50 N/15 mm that is recommended in the present technical field.

(a2) The pouch of each level having the top seal part formed as described above was subjected to retort treatment (temperature: 120 degrees, time: 30 minutes), and was left to stand for 1 day. Then, the pouch was heated (microwaved) in a microwave for 80 seconds at 600 W.

(a3) The retraction amount of the top seal part (the detachment amount from the accommodation space S side) in each pouch was measured after heating.

In Evaluation Experiment I, six pouches having the top seal part of level 1 were prepared in (a1) above, and (a2) and (a3) above were carried out with respect to each pouch. Similarly, six pouches having the top seal part of level 2 were prepared in (a1) above, and (a2) and (a3) above were carried out with respect to each pouch. Similarly, six pouches having the top seal part of level 3 were prepared in (a1) above, and (a2) and (a3) above were carried out with respect to each pouch.

Evaluation Experiment I described above was carried out with respect to the pouch 10A, the pouch 10B, and the pouch 46. The evaluation results for the pouch 10A are as shown in Table 1, the evaluation results for the pouch 10B are as shown in Table 2, and the evaluation results for the pouch 46 are as shown in Table 3. No. 1 to No. 6 in Tables 1, 2 and 3 are numbers for distinguishing the six pouches, and the average values are the average values of the results of No. 1 to No. 6.

TABLE 1

| | Retraction amount (mm) | | | | | | |
|---|---|---|---|---|---|---|---|
| Example 1 | No. 1 | No. 2 | No. 3 | No. 4 | No. 5 | No. 6 | Average value |
| Level 1 | 3.0 | 3.5 | 3.0 | 2.5 | 2.8 | 2.1 | 2.8 |
| Level 2 | 0.5 | 2.0 | 0.6 | 2.8 | 2.5 | 2.8 | 1.9 |
| Level 3 | 3.0 | 0.5 | 3.0 | 1.0 | 1.9 | 1.2 | 1.8 |

TABLE 2

| | Retraction amount (mm) | | | | | | |
|---|---|---|---|---|---|---|---|
| Example 2 | No. 1 | No. 2 | No. 3 | No. 4 | No. 5 | No. 6 | Average value |
| Level 1 | 3.0 | 3.0 | 4.0 | 2.7 | 1.8 | 2.8 | 2.9 |
| Level 2 | 1.5 | 2.5 | 3.5 | 0.9 | 1.9 | 1.1 | 1.9 |
| Level 3 | 1.5 | 1.0 | 1.5 | 1.1 | 1.1 | 1.5 | 1.3 |

TABLE 3

| | Retraction amount (mm) | | | | | | |
|---|---|---|---|---|---|---|---|
| Comparative Example 1 | No. 1 | No. 2 | No. 3 | No. 4 | No. 5 | No. 6 | Average value |
| Level 1 | 9.0 | 6.0 | 6.0 | 9.0 | 3.3 | 3.7 | 6.2 |
| Level 2 | 5.0 | 9.0 | 6.0 | 3.2 | 4.2 | 4.8 | 5.4 |
| Level 3 | 3.5 | 4.7 | 3.0 | 4.0 | 5.0 | 3.3 | 3.9 |

Figure 17:
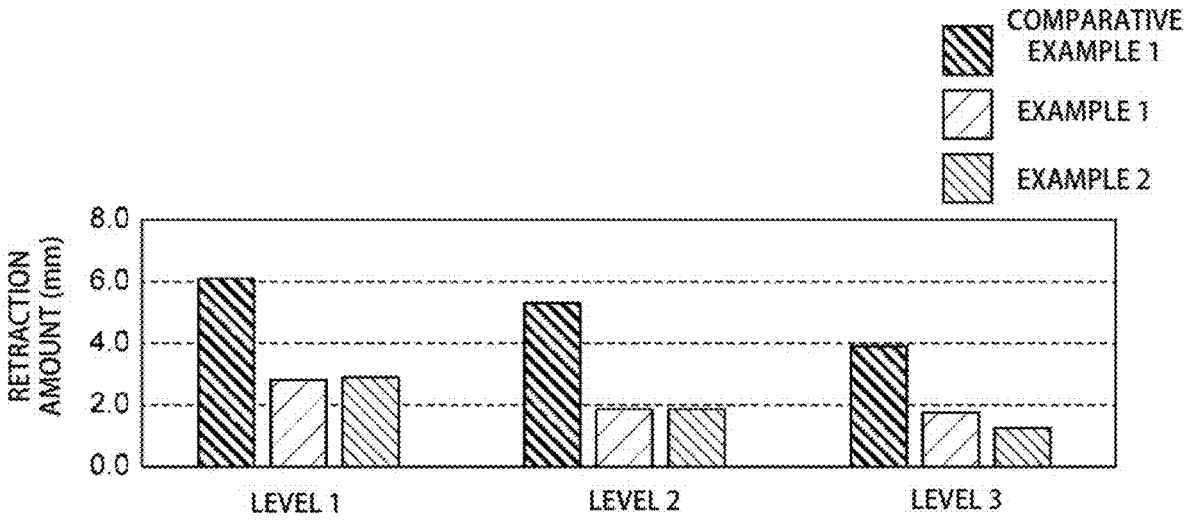
FIG. 17 is a diagram showing the evaluation experiment results relating to the retraction amount of the top seal part.

FIG. 17 is a diagram showing the average values of Tables 1 to 3 above in a bar graph.

It can be understood from Tables 1 to 3, and FIG. 17, that in Example 1 and Example 2, the retraction amount is reduced compared to Comparative Example 1. Further, as shown in Table 3, in Comparative Example 1, in some cases the retraction amount was 9 mm and the top seal part had completely detached. In contrast, the maximum retraction amount in Example 1 was 4 mm, and the maximum retraction amount in Example 2 was 3.5 mm. That is, in Example 1 and Example 2, complete detachment of the top seal part did not occur. Therefore, it can be understood that, as a result of including the triangular shaped steam releasing seal part and forming the penetration part in the non-sealed region, it is possible to suppress retraction of the top seal part even when the seal strength of the top seal part is lower than the recommended seal strength.

Evaluation Relating to Rotation of Pouch During Heating

Evaluation Experiment II relating to the rotation state of the pouch when the pouches 10A to 10H of Examples 1 to 8 were heated was performed. The method of Evaluation Experiment II will be described referring to the pouches 10A to 10H as a pouch.

Evaluation Experiment II (b1) After accommodating 100 g of water in the open state pouch, the top seal part was formed by heat sealing the top part. The seal width of the top seal part (seal width W1 in FIG. 2) was 9 mm, and the seal strength of the top seal part was 30 N/15 mm.

(b2) The pouch formed having the top seal part as described above was heated (microwaved) in a microwave for 1 minute at 1,800 W. The rotation state of the pouch was observed during the heating, and the number of rotations was counted.

In Evaluation Experiment II, five pouches were prepared in (b1) above, and (b2) above was carried out with respect to each pouch.

Evaluation Experiment II described above was carried out with respect to the pouches 10A to 10H, and the pouch 56. The results of Evaluation Experiment II were as shown in Table 4. No. 1 to No. 5 in Table 4 are numbers for distinguishing the five pouches, and the average value is the average value of the results (number of rotations) of No. 1 to No. 5.

TABLE 4

| | Number of Rotations | | | | | |
|---|---|---|---|---|---|---|
| | No. 1 | No. 2 | No. 3 | No. 4 | No. 5 | Average value |
| Example 1 (Pouch 10A) | 0.4 | 0.3 | 0.6 | 0.2 | 0.2 | 0.34 |
| Example 2 (Pouch 10B) | 0.2 | 0.4 | 0 | 0.7 | 0 | 0.26 |
| Example 3 (Pouch 10C) | 1.5 | 1.2 | 0.6 | 0.8 | 1 | 1.02 |
| Example 4 (Pouch 10D) | 1.8 | 0.7 | 0.6 | 0.3 | 1.8 | 1.04 |
| Example 5 (Pouch 10E) | 0.9 | 0.2 | 0.3 | 0.4 | 0.6 | 0.48 |
| Example 6 (Pouch 10F) | 0.4 | 0.5 | 0.8 | 0.4 | 0.4 | 0.5 |
| Example 7 (Pouch 10G) | 1.7 | 2.2 | 2.2 | 1.8 | 2 | 1.98 |
| Example 8 (Pouch 10H) | 3.2 | 2.7 | 4.1 | 3 | 1.8 | 2.96 |

As a result of carrying out Evaluation Experiment II above with respect to the pouches 10A to 10H from Examples 1 to 8, as shown in Table 4, an average number of rotations of 3 rotations or less was achieved in Examples 1 to 8.

Therefore, by forming the penetration part in the non-sealed region, it is possible to appropriately discharge steam during heating of the pouch, and it can be understood that rotation of the pouch can be suppressed during heating. In particular, in Examples 1 to 6, in which the arrangement of the penetration part satisfied condition (3) described in the embodiment above, rotation was more difficult than in Examples 7 and 8, in which the arrangement of the penetration part did not satisfy condition (3). Therefore, by forming the penetration part to at least satisfy condition (3) above, it can be understood that rotation can be suppressed, that is, the pouch is stable during heating of the pouch. Further, in Examples 1 to 6, 1 rotation or less could be achieved as the average number of rotations, and in Examples 1, 2 and 5, fewer than 0.5 rotations could be achieved as the average number of rotations. That is, it can be understood that it is possible to further stabilize the pouch during heating of the pouch in Examples 1 to 6, and particularly in Examples 1, 2, and 5.

REFERENCE SIGNS LIST

10, 10A, 10B, 10C, 10D, 10E, 10F, 10G, 10H . . . Pouch, 10*a* . . . Side edge, 10*b* . . . Side edge, 12 . . . Bottom part, 14 . . . Top part; 16 . . . Sheet part, 18 . . . Sheet part, 20 . . . Sheet part; 22 . . . Bottom seal part, 26 . . . Side seal part, 28 . . . Side seal part, 24 . . . Top seal part, 30 . . . First upper seal part (first seal part), 32 . . . First lower seal part (second seal part), 34 . . . Steam releasing seal part, 36 . . . Non-sealed region 38 . . . Peak part, 44 . . . Penetration part, 100 . . . Contents, 441 . . . First end, 442 . . . Second end, S . . . Accommodation space, VL1 . . . First virtual line, VL2 . . . Second virtual line, VL3 . . . Third virtual line.

What is claimed is:

1. A pouch having an accommodation space that accommodates contents between a bottom part and a top part on an opposite side to the bottom part, the pouch comprising:

a pair of stacked sheet parts; and a pair of side seal parts that are provided at both edges extending in a first direction of the pair of sheet parts and sealed so that the pair of sheet parts forms the accommodation space;

wherein of the pair of side seal parts, at least one side seal part has a first seal part that is positioned close to the top part, a second seal part that is positioned closer to the bottom part than the first seal part is and separated from the first seal part, and a steam releasing seal part for releasing steam that connects the first seal part and the second seal part, and projects onto the accommodation space side, the steam releasing seal part exhibits a triangular shape having a peak part on the accommodation space side, and is symmetrical with respect to a first virtual line passing through the peak part and orthogonal to the first direction, a region surrounded by the steam releasing seal part is a non-sealed region, and the non-sealed region of at least one sheet part among the pair of sheet parts has a penetration part that penetrates the at least one sheet part in a thickness direction, wherein the penetration part has a first end, and a second end on an opposite side to the first end, a region of the penetration part other than between the first end and the second end is separated from a second virtual line that connects the first end and the second end, the second virtual line form an angle θ2 with a side edge of the pouch and a value of the angle θ2 is from −25 degrees to 25 degrees.

2. The pouch of claim 1, wherein the penetration part exhibits an arc shape.

3. The pouch of claim 1, wherein at least part of the penetration part is on the first virtual line.

4. The pouch of claim 1, wherein a part of the penetration part is further toward an accommodation space side than to a third virtual line that virtually extends an edge of the first seal part and the second seal part that is positioned most toward the accommodation space side.

5. The pouch of claim 1, wherein the penetration part is formed in both of the pair of sheet parts.

6. The pouch of claim 1, wherein the penetration part corresponds to one quarter of a circumference of a circle.

* * * * *